US007744421B2

(12) United States Patent
Harada

(10) Patent No.: US 7,744,421 B2
(45) Date of Patent: Jun. 29, 2010

(54) CARD CONNECTOR AND METHOD OF ASSEMBLING SAME

(75) Inventor: Keita Harada, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 12/166,367

(22) Filed: Jul. 2, 2008

(65) Prior Publication Data

US 2009/0111288 A1 Apr. 30, 2009

(30) Foreign Application Priority Data

Oct. 29, 2007 (JP) ..... 2007-279949
Oct. 29, 2007 (JP) ..... 2007-279950

(51) Int. Cl.
*H01R 24/00* (2006.01)

(52) U.S. Cl. ..... 439/630

(58) Field of Classification Search ..... 439/630, 439/631, 632, 541.5, 188, 489
See application file for complete search history.

(56) References Cited

U.S. PATENT DOCUMENTS 6,120,322 A * 9/2000 Ho et al. ..... 439/541.5
6,685,512 B2 * 2/2004 Ooya ..... 439/630
7,112,077 B2 * 9/2006 Kikuchi ..... 439/188
2006/0099856 A1 * 5/2006 Takei et al. ..... 439/630
2006/0276082 A1 * 12/2006 Hung et al. ..... 439/630
2007/0128942 A1 * 6/2007 Li ..... 439/630

FOREIGN PATENT DOCUMENTS

JP 2001-167844 6/2001
JP 2005-050792 2/2005

* cited by examiner

*Primary Examiner*—T C Patel
*Assistant Examiner*—Phuong Nguyen
(74) *Attorney, Agent, or Firm*—IPUSA, PLLC

(57) ABSTRACT

A card connector is disclosed that includes a first housing configured to have a first card inserted thereinto to be attached thereto; a second housing configured to have a second card inserted thereinto to be attached thereto, the second housing being provided on the first housing; and multiple contact members for the second card combined with the first housing by insert molding, the contact members each having, at a first end, a contact arm part to come into contact with a terminal of the second card, and at a second end, a lead terminal part to be soldered to a pad on a board, wherein the contact arm parts are placed inside the second housing with the intermediate portions thereof fixed to part of the second housing.

17 Claims, 17 Drawing Sheets

CARD CONNECTOR AND METHOD OF ASSEMBLING SAME

BACKGROUND OF THE INVENTION

1. Field of the Invention

The present invention relates generally to card connectors and methods of assembling the same, and particularly to a memory card connector that is incorporated in electronic apparatuses such as digital cameras to allow a memory card to be attached thereto and a method of assembling the memory card connector.

2. Description of the Related Art

Electronic apparatuses such as digital cameras, portable audio apparatuses, cellular phones, and electronic copiers have a memory card connector incorporated therein and are used with a memory card having a built-in semiconductor memory device being attached to the memory card connector.

Currently, there are multiple kinds of memory cards such as Memory Stick (trademark), Memory Stick Duo (trademark), SD Memory Card (trademark), and MMC (MultiMedia Card) (trademark). With commercial availability of multiple kinds of memory cards, memory card connectors have been commercialized that allow selective attachment of any kind of memory card. This type of memory card connector is mounted on a printed circuit board with its lead terminal parts soldered to corresponding pads on the printed circuit board.

Memory card connectors of this type are divided into those having a single memory card insertion slot common to multiple kinds of memory cards and those having an upper memory card insertion slot and a lower memory card insertion slot. The latter memory card connectors have an advantage over the former memory card connectors in that more kinds of memory cards are attachable.

FIG. 1 is a diagram showing a structure of a conventional memory card connector 1 of the latter type.

The memory card connector 1 has the structure where an upper housing 5 in which contact members 6 are provided by insert molding is stacked on and fixed to a lower housing 2 in which contact members 3 are provided by insert molding. The memory card connector 1 is mounted on a printed circuit board 10 with lead terminal parts 3*a* and 6*a* thereof being soldered to corresponding pads 10*a* and 10*b*, respectively, on the printed circuit board 10. (See, for example, Japanese Laid-Open Patent Application No. 2005-50792.)

In this memory card connector 1 having a two-tier structure, variations in the arrangement of the lead terminal parts 6*a* of the contact members 6 of the upper housing 5 result from variations in the contact members 6 themselves together with assembly error in attachment of the upper housing 5 onto the lower housing 2. In some cases, the variations increase so that some lead terminal parts 6*a* may be out of contact with the corresponding pads 10*a* of the printed circuit board 10 when the memory card connector 1 is mounted on the printed circuit board 10.

Further, as described above, there are multiple kinds of memory cards at present. The method of detecting the attachment (attached state) of a memory card to a memory card connector differs depending on the type of the memory card. One method is to detect the attachment of a memory card through contact of a predetermined one of the terminals of the memory card with a corresponding contact in the memory card connector. The other method is to detect the attachment of a memory card by causing a switch provided in the memory card connector to operate by a side of the memory card pressing the switch. The former method is employed for Memory Stick (trademark) and Memory Stick Duo (trademark), and the latter method is employed for SD Memory Card (trademark) and MMC (MultiMedia Card) (trademark).

FIGS. 2A and 2B are diagrams for illustrating attachment of a memory card to a conventional memory card connector.

FIG. 2A shows a conventional memory card connector 1*a* without its cover.

Referring to FIG. 2A, an SD memory card 20 has a knob 23 provided in a recess 22 on an $X_2$-side surface 21 thereof to be slidable between a write inhibit (write protect) position P1 and a write enable position P2.

Accordingly, the memory card connector 1*a* to which the SD memory card 20 is attached has an internal switch for detecting the attached SD memory card 20, which is not graphically illustrated but is usually placed at the bottom ($Y_1$) side of the memory card connector 1*a*, and an internal switch 9 for detecting the position of the knob 23 of the attached SD memory card 20.

The switch 9 includes a fixed terminal 11 and a movable terminal 12. The movable terminal 12 has a U-shaped part 12*a* in the middle and a projection part 12*b* at its $Y_2$ end.

Referring to FIG. 2B, when the SD memory card 20 is inserted into and attached to the memory card connector 1*a* with its knob 23 being set to the write enable position P2, the movable terminal 12 is bent by having its U-shaped part 12*a* pressed by the knob 23, so that the projection part 12*b* comes into contact with the fixed terminal 11 to turn on the switch 10. (See, for example, Japanese Laid-Open Patent Application No. 2001-167844.)

In general, in a switch having a movable terminal and a fixed terminal, a foreign object may be sandwiched between the movable terminal and the fixed terminal to cause poor contact. In the above described switch 9, it is desirable to ensure as long a wiping distance of the projection part 12*b* rubbing and moving on the surface of the fixed terminal 11 as possible in order to avoid poor contact due to sandwiching of a foreign object between the projection part 12*b* of the movable terminal 12 and the fixed terminal 11.

In the case of the above-described switch 9, however, the wiping direction is the $Y_1$ direction perpendicular to the $X_2$ direction in which the U-shaped part 12*a* is pressed, so that the wiping distance is extremely short. Therefore, it is difficult to increase the reliability of the switch 9, that is, the reliability of the memory card connector 1*a*.

SUMMARY OF THE INVENTION

Embodiments of the present invention may solve or reduce one or more of the above-described problems.

According to one embodiment of the present invention, there are provided a card connector in which one or more of the above-described problems may be solved or reduced and a method of assembling the same.

According to one embodiment of the present invention, there is provided a card connector including a first housing configured to have a first card inserted thereinto to be attached thereto; a second housing configured to have a second card inserted thereinto to be attached thereto, the second housing being provided on the first housing; and a plurality of contact members for the second card combined with the first housing by insert molding, the contact members each having, at a first end, a contact arm part to come into contact with a terminal of the second card, and at a second end, a lead terminal part to be soldered to a pad on a board, wherein the contact arm parts are placed inside the second housing with intermediate portions thereof fixed to a part of the second housing.

According to one embodiment of the present invention, there is provided a method of assembling a card connector including a first housing configured to have a first card inserted thereinto to be attached thereto and a second housing configured to have a second card inserted thereinto to be attached thereto, the second housing being provided on the first housing, the method including the steps of combining a plurality of contact members for the second card with the first housing by insert molding, the contact members each having, at a first end, a contact arm part to come into contact with a terminal of the second card, and at a second end, a lead terminal part to be soldered to a pad on a board; bending the contact arm parts of the contact members combined with the first housing by insert molding so that the contact arm parts are parallel to a surface of the first housing facing toward the second housing with ends of the contact arm parts facing a side from which the first card is inserted; and attaching the second housing to the first housing by sliding the second housing on the surface of the first housing from the side from which the first card is inserted so that intermediate portions of the contact arm parts are fixed inside the second housing and the second housing is engaged with and fixed onto the first housing.

According to the above-described card connector and method of assembling a card connector, the contact members for the second card is combined with the first housing by insert molding, and the first housing does not include contact members for the second card and is placed on the first housing. Therefore, the vertical positions of the lead terminal parts are not affected by the accuracy of attachment of the second housing onto the first housing. Accordingly, it is possible to increase the accuracy of the vertical positions of the lead terminal parts compared with the structure where a second housing with which contact members for the second card are combined by insert molding is attached onto a first housing. As a result, in the case of mounting the card connector on a printed circuit board, there occurs no mounting failure where some lead terminal parts are out of contact with corresponding pads on the printed circuit board, so that it is possible to mount the card connector onto the printed circuit board with more accuracy.

According to one embodiment of the present invention, there is provided a card connector including a housing configured to have a card attached thereto; and a detection switch configured to detect the attachment of the card to the housing, the detection switch including a movable terminal configured to be pressed by the attached card to be elastically bent and a fixed terminal spaced away from and facing the movable terminal, wherein the movable terminal includes an arm part configured to be pressed by the attached card to be elastically bent and a contact part extending from the arm part in a direction in which the arm part is bent, the fixed terminal is shaped to be rubbed by the contact part in response to the bending of the arm part, and the contact part is configured to be displaced in the direction in which the arm part is bent to come into contact with and rub the fixed terminal in response to the bending of the arm part.

According to the above-described card connector, the contact part is displaced in the direction in which the arm part is bent so as to come into contact with and rub the fixed terminal. Therefore, the distance over which the contact part rubs the fixed terminal, that is, the wiping distance, can be significantly longer than it is conventionally, so that it is possible to increase the reliability of the detection switch and accordingly to increase the reliability of the card connector.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given below, with reference to the accompanying drawings, of an embodiment of the present invention.

In the following drawings, $X_1$-$X_2$ indicates the directions of width, $Y_1$-$Y_2$ indicates the directions of length, and $Z_1$-$Z_2$ indicates the directions of thickness (height) of a memory card connector or a memory card. Further, $Y_1$ indicates the direction in which the memory card is inserted into the memory card connector, and $Y_2$ indicates the direction in which the memory card is ejected from the memory card connector.

Figure 3:
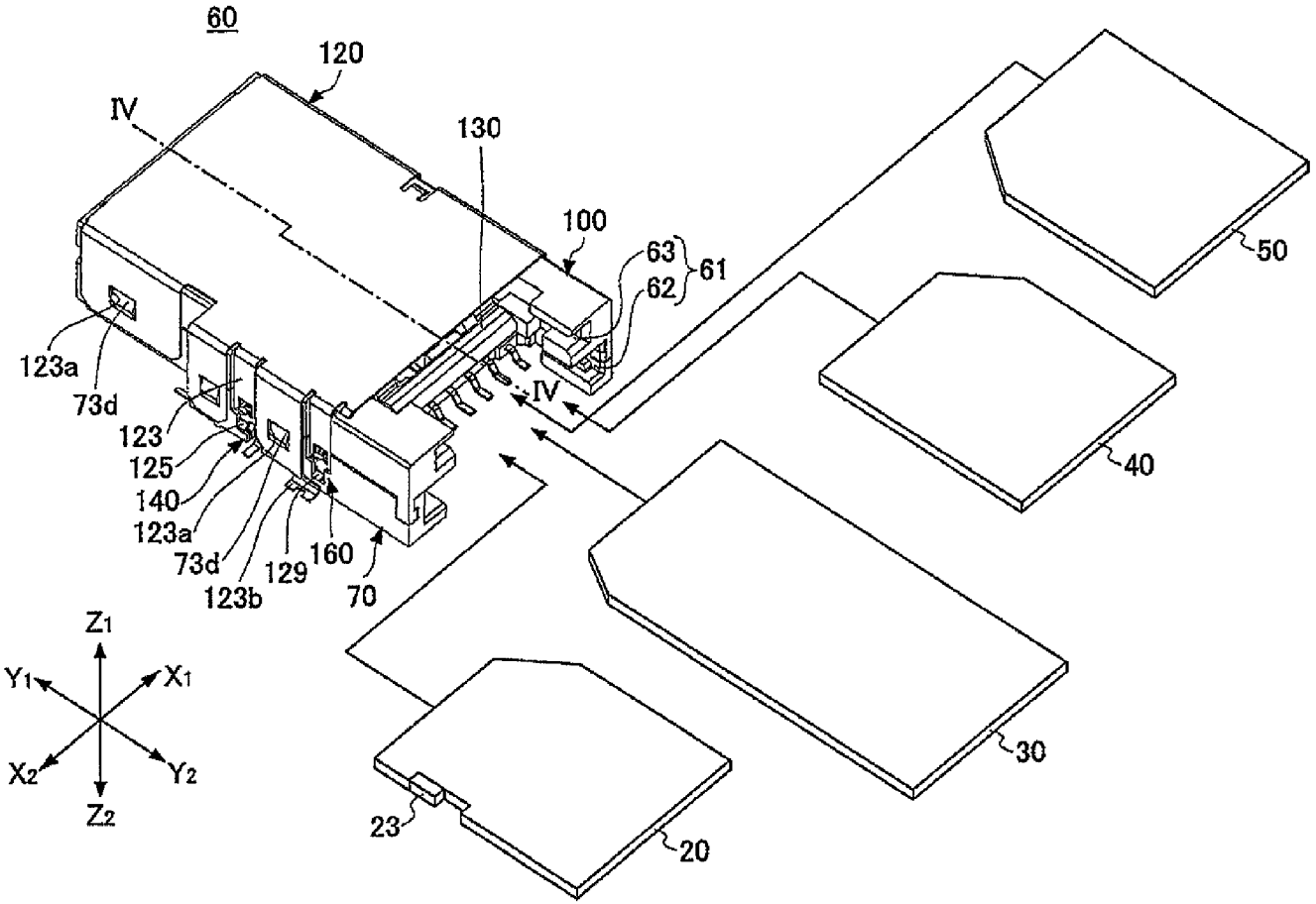
FIG. 3 is a perspective view of a memory card connector and various memory cards attachable thereto according to an embodiment of the present invention.

FIG. 3 is a perspective view of a memory card connector 60 according to an embodiment of the present invention.

Figure 4:
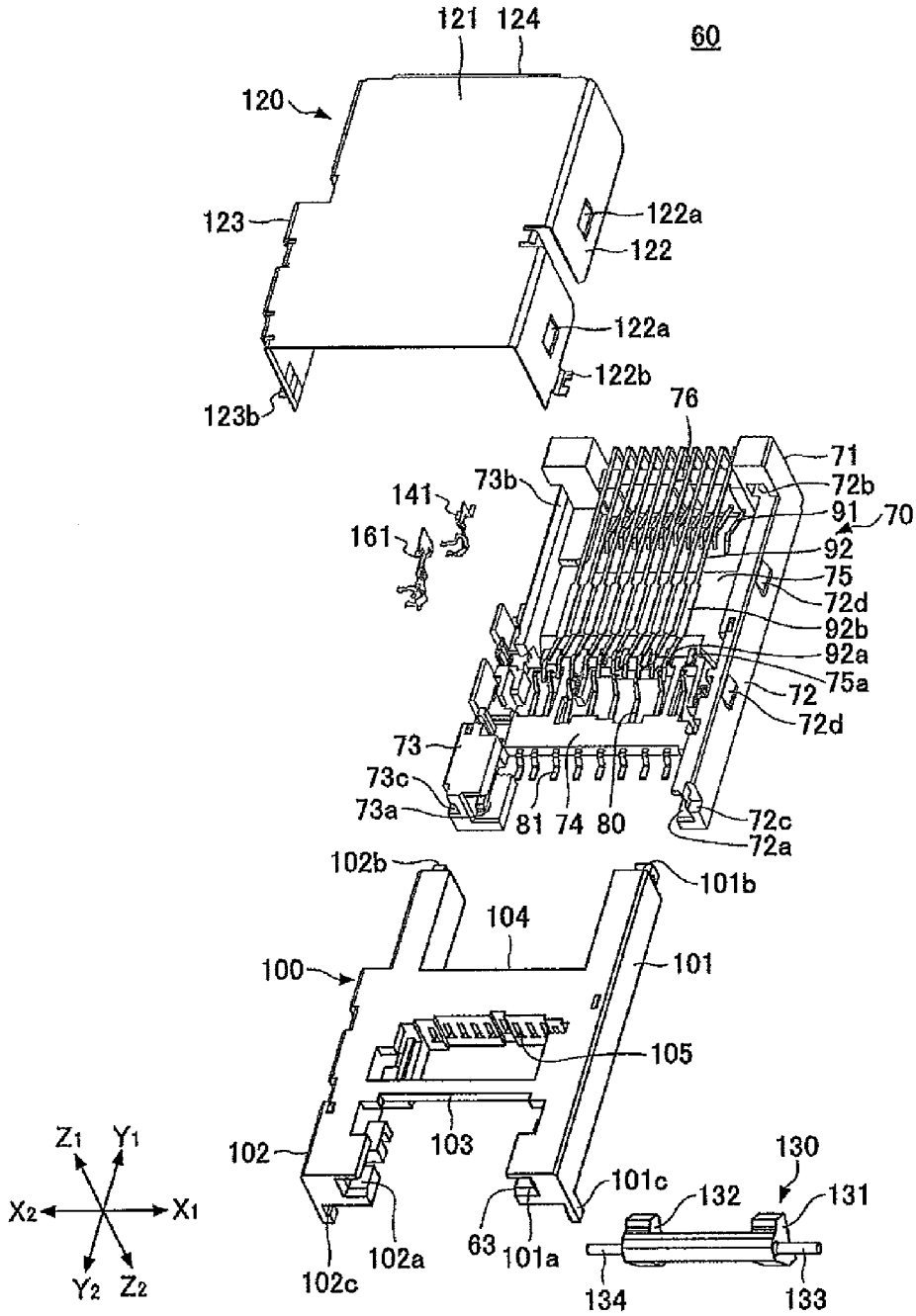
FIG. 4 is an exploded perspective view of the memory card connector of FIG. 3 according to the embodiment of the present invention.

FIG. 4 is an exploded perspective view of the memory card connector 60 of FIG. 3.

Figure 5:
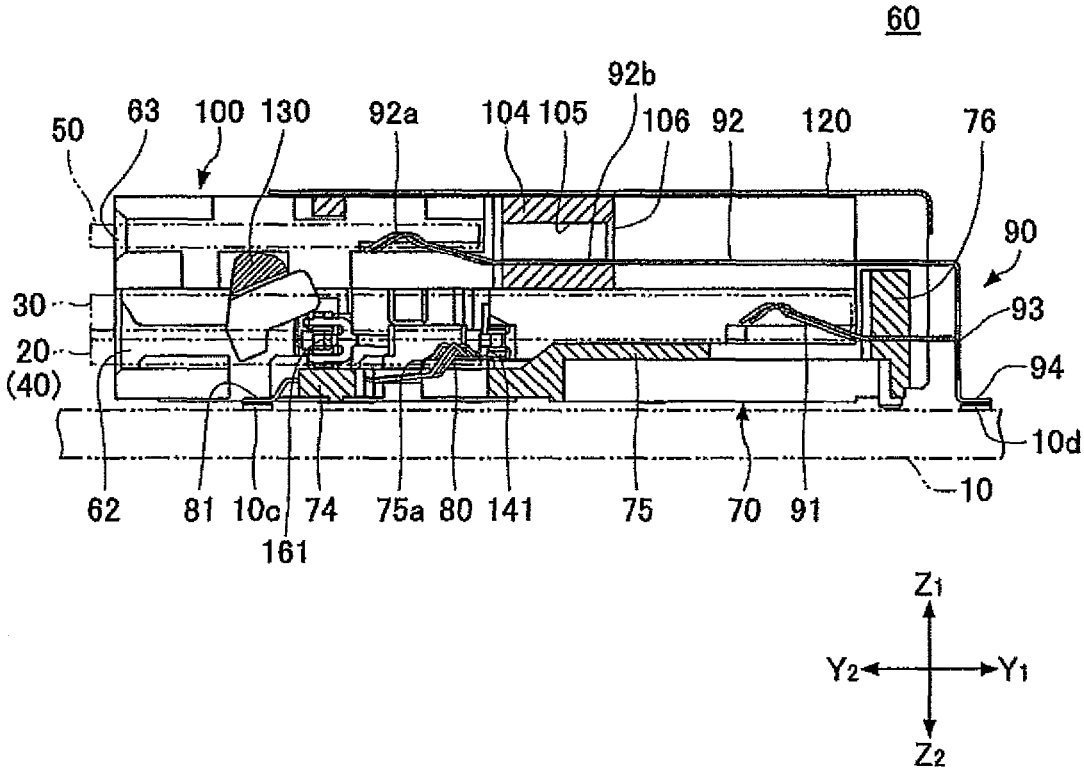
FIG. 5 is a cross-sectional view of the memory card connector taken along a vertical plane including the line IV-IV of FIG. 3 according to the embodiment of the present invention.

FIG. 5 is a cross-sectional view of the memory card connector 60 taken along the line IV-IV of FIG. 3.

[General Structure of Memory Card Connector 60]

Referring to FIG. 3, FIG. 4, and FIG. 5, the memory card connector 60 includes a lower housing module 70, an upper housing 100 stacked on the upper surface of the lower housing module 70, and a metal-plate cover member 120 that covers the upper housing 100. The memory card connector 60 has a misinsertion preventing member 130, a first detection switch 140, and a second detection switch 160 provided therein. The memory card connector 60 has an insertion opening 61 at its $Y_2$ end. The insertion opening 61 includes a lower insertion slot (opening) 62 corresponding to the lower housing module 70 and an upper insertion slot (opening) 63 corresponding to the upper housing 100.

The memory card connector 60 is mounted on the printed circuit board 10 with below-described lead terminal parts 81 and 94 being soldered to corresponding pads 10*c* and 10*d*, respectively, on the printed circuit board 10. The memory card connector 60 is incorporated in an electronic apparatus together with the printed circuit board 10 so that the insertion opening 61 is exposed on the exterior surface of the electronic apparatus.

The SD memory card 20, a memory stick 30, or a multimedia card 40 is selectively attachable to the memory card connector 60 using the lower insertion slot 62, and a memory stick Duo 50 is attachable to the memory card connector 60 using the upper insertion slot 63.

Here, the memory stick 30 and the memory stick Duo 50 have the same terminal arrangement, and the memory stick Duo 50 is three-fifths as long as the memory stick 30. The SD memory card 20 and the multimedia card 40 have substantially the same outside dimensions, substantially the same length as the memory stick Duo 50, a little larger width than the memory stick 30, and the same terminal arrangement, but are different in that the SD memory card 20 has the knob 23.

[Structure of Lower Housing Module 70]

Referring in particular to FIG. 4 and FIG. 5, the lower housing module 70 is an insert molded component having contact members 80 and double-contact members 90 combined with a lower housing main body 71 of synthetic resin by insert molding. In this specification, a double-contact member refers to a contact member having two contact arm parts. Further, movable terminal members 141 and 161 forming the first and second detection switches 140 and 160, respectively, are press-fit into and fixed to the lower housing main body 71. A description is given below of the first and second detection switches 140 and 160.

The lower housing main body 71, which has a substantially quadrilateral frame shape, includes an $X_1$-side frame rod 72, an $X_2$-side frame rod 73, and three horizontally laid parts 74, 75, and 76. The frame rods 72 and 73 have respective guide grooves 72*a* and 73*a* on their interior side. The center horizontally laid part 75 has projection parts 75*a* projecting in the $Z_1$ direction on its $Y_2$-side step part.

The contact members 80 are inserted in the horizontally laid part 74 positioned close to the lower insertion slot 62, and are arranged in correspondence to the terminals of each of the SD memory card 20 and the multimedia card 40.

The double-contact members 90 are combined with the $Y_1$-end horizontally laid part 76 by insert molding.

Figure 6:
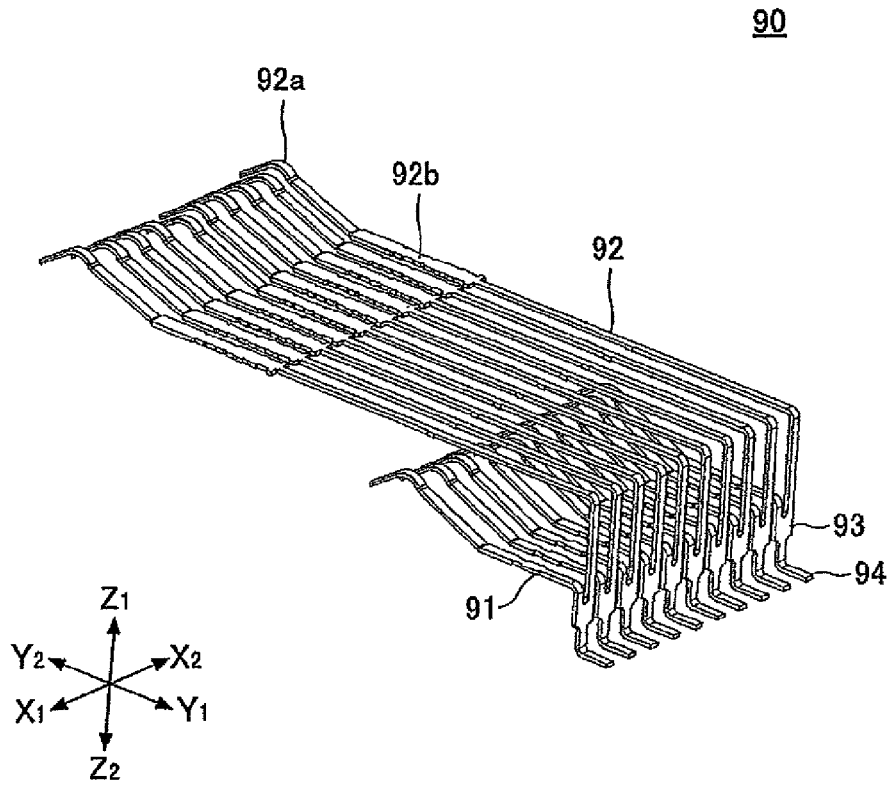
FIG. 6 is a perspective view of double-contact members according to the embodiment of the present invention.

FIG. 6 is a perspective view of the double-contact members 90.

Referring to FIG. 5 along with FIG. 6, each double-contact member 90 has a first (shorter) contact arm part 91, a second (longer) contact arm part 92 longer than the first contact part 91, and the lead terminal part 94. The contact arm part 91, the contact arm part 92, and the lead terminal part 94 are connected at a base 93 of the contact arm part 91. The lead terminal part 94 extends in the $Y_1$ direction from the base 93 of the contact arm part 91. The contact arm part 91 is combined with the horizontally laid part 76 by insert molding.

The contact arm parts 91 of the double-contact members 90 are arranged in correspondence to the arrangement of the terminals of the memory stick 30. The contact arm parts 92 are vertically positioned on the $Z_1$ side relative to the frame rods 72 and 73 to extend in the $Y_2$ direction, and are arranged in correspondence to the arrangement of the terminals of the memory stick Duo 50. Each contact arm part 92 has an inverse V-shaped contact part 92*a* at its $Y_2$ end and a bulge part 92*b* continuing from the contact part 92*a*.

[Shape of Upper Housing 100]

Referring in particular to FIG. 4, the upper housing, which is a molded component of synthetic resin, has a frame shape and includes an $X_1$-side frame rod 101, an $X_2$-side frame rod 102, and two horizontally laid parts 103 and 104. The frame rods 101 and 102 have respective guide grooves 101*a* and 102*a* on their interior side.

Multiple through holes 105 are formed in the horizontally laid part 104. As shown enlarged in FIG. 10, the through holes 105 correspond to the contact arm parts 92, and are large enough to allow the corresponding contact arm parts 92*a* to penetrate therethrough. Each through hole 105 has a slit part 107 large enough to allow the corresponding bulge part 92*b* to be press-fit thereinto, formed at its $Z_2$-side end, and has a tapered part 106 formed at its $Y_1$-side entrance.

[Shape of Cover Member 120]

Referring to FIG. 4, the cover member 120 has a top plate part 121, side plate parts 122 and 123 on the $X_1$ and $X_2$ sides, respectively, and a $Y_1$-side plate part 124.

Referring to FIG. 3, a fixed terminal part 125 of the first detection switch 140 and a fixed terminal part 129 of the second detection switch are formed on the side plate part 123.

[Shape of Misinsertion Preventing Member 130]

Referring to FIG. 4, the misinsertion preventing member 130 has triangular parts 131 and 132 on the $X_1$ and $X_2$ sides, respectively, and has shaft parts 133 and 134 projecting from its $X_1$ and $X_2$ ends, respectively.

[Assembly Processes of Memory Card Connector 60]

The memory card connector 60 is assembled through the process of manufacturing the lower housing module 70, the process of attaching the upper housing 100, and the process of attaching the cover member 120.

(Manufacturing Process of Lower Housing Module 70)

First, the lower housing module 70 is manufactured through the process of insert molding and the bending of the contact arm parts 92A. Suffix A of reference numeral 92A indicates the state before bending.

<Insert Molding>

Figure 7A:
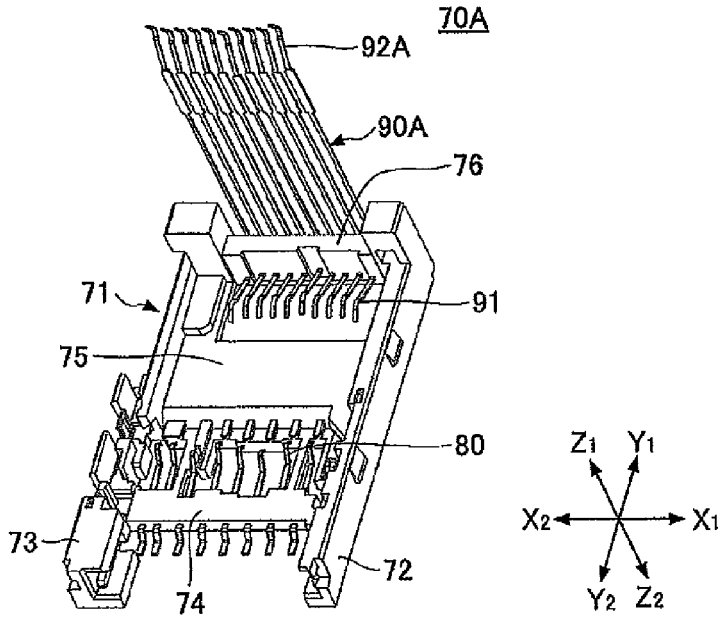
FIGS. 7A and 7B are diagrams showing a lower housing module in which the double-contact members before bending are provided by insert molding according to the embodiment of the present invention.
Figure 7B:
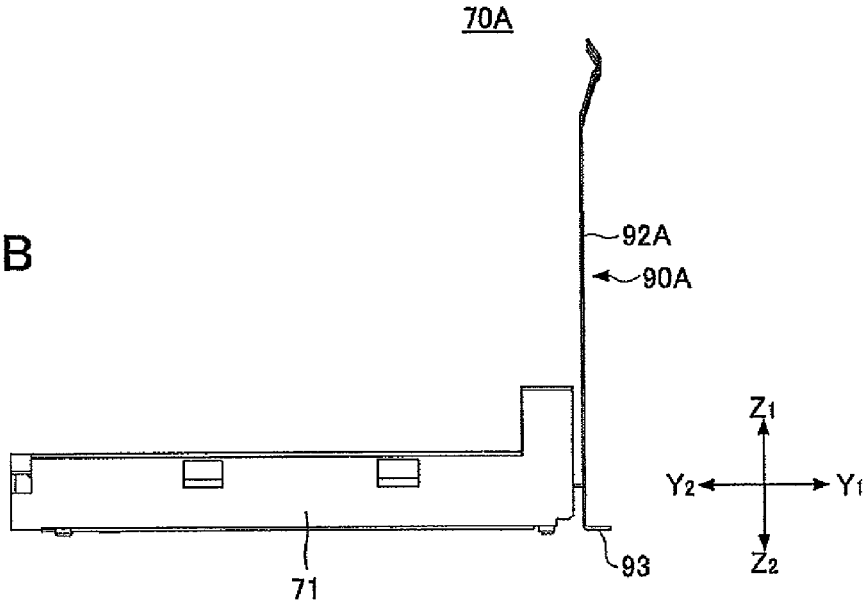

FIGS. 7A and 7B are diagrams showing a lower housing module 70A in which double-contact members 90A are provided by insert molding.

Figure 8:
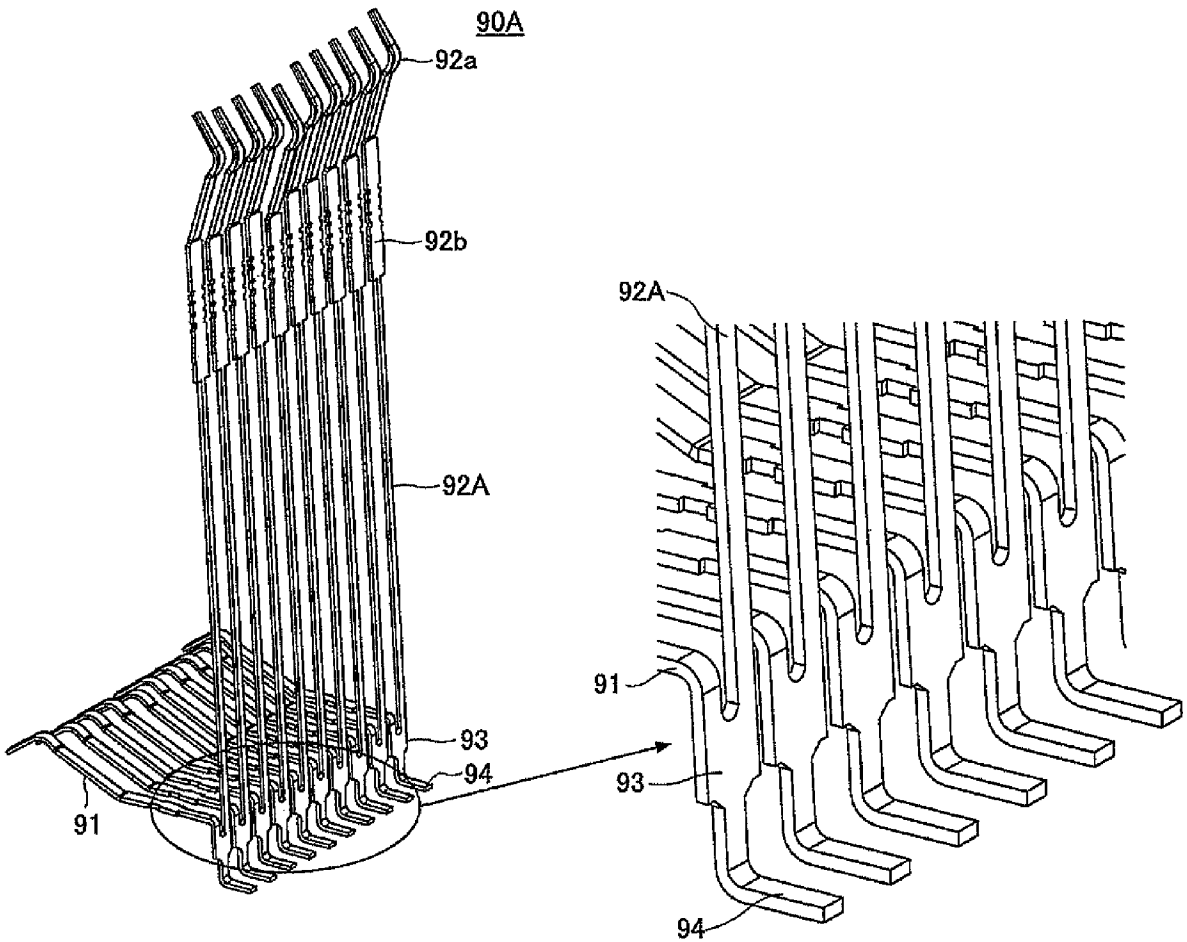
FIG. 8 is a diagram showing the double-contact members to be inserted according to the embodiment of the present invention.

FIG. 8 is a diagram showing the double-contact members 90A before the contact arm parts 92A are bent.

The lower housing module 70A shown in FIGS. 7A and 7B are manufactured by setting the contact members 80 and the double-contact members 90A shown in FIG. 8 in a mold; molding the lower housing main body 71 by injecting synthetic resin into the mold; and providing the contact members 80 and the double-contact members 90A in the horizontally laid part 74 and the horizontally laid part 76, respectively, by insert molding.

Referring to FIG. 8, each double-contact member 90A has the contact arm part 91 extending in the $Y_2$ direction on one end side and the lead terminal part 94 extending in the $Y_1$ direction on the other end side, and the contact arm part 92A branches off at the base 93 of the contact arm part 91 to extend in the $Z_1$ direction. The contact arm part 91, the contact arm part 92A, and the lead terminal part 94 are joined at the base 93. Viewing from the $X_1$ side, the contact arm part 92A forms a 90° angle with respect to the contact arm part 91. The lead terminal part 94, which is bent like an L-letter shape, is a terminal to be soldered to the corresponding pad 10*d* on the printed circuit board 10 when the memory card connector 60 is mounted on the printed circuit board 10.

Each double-contact member 90A has a portion near the base 93 of the contact arm part 91 provided in (combined with) the horizontally laid part 76 by insert molding. The contact arm parts 91 are arranged in correspondence to the arrangement of the terminals of the memory stick 30. The contact arm parts 92A face the $Z_1$ direction.

At the time of setting the contact members 80 and the double-contact members 90A in a mold, all the contact members 80 and all the double contact members 90A are arranged like comb teeth, and are cut to be independent after insert molding.

<Bending of Contact Arm Parts 92A>

Figure 9A:
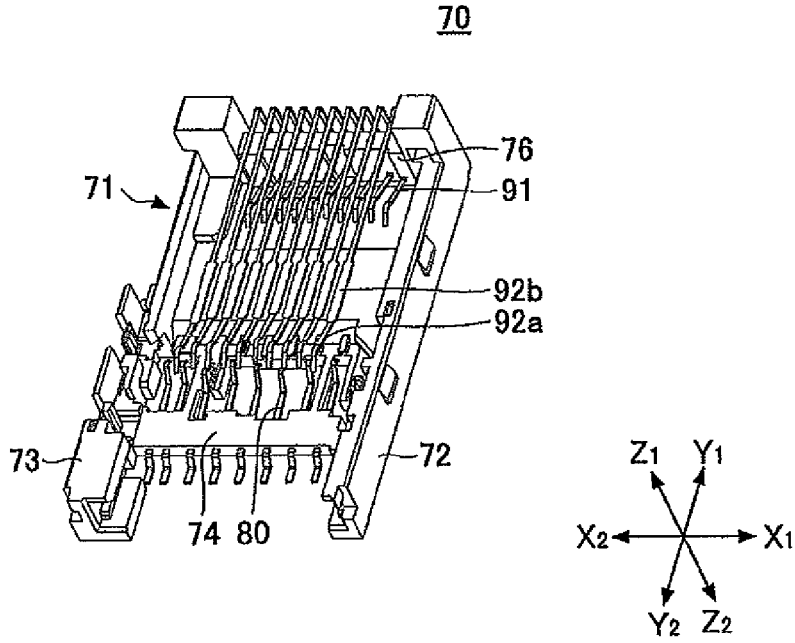
FIGS. 9A and 9B are diagrams showing the lower housing module where contact arm parts are bent according to the embodiment of the present invention.
Figure 9B:
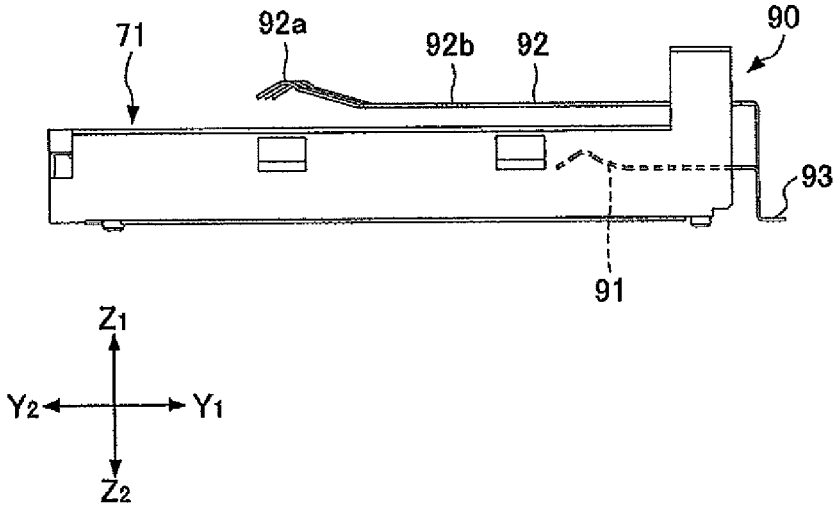

Next, as shown in FIGS. 9A and 9B, the contact arm parts 92A are bent 90° to face the $Y_2$ direction, to be the contact arm parts 92. The contact arm parts 92 are vertically positioned on the $Z_1$ side relative to the frame rods 72 and 73, and extend in the $Y_2$ direction. The contact arm parts 92 are arranged in correspondence with the arrangement of the terminals of the memory stick Duo 50. Each contact arm part 92 has the inverse V-shaped contact part 92*a* at its $Y_2$ end and the bulge part 92*b* continuing from the contact part 92*a*.

The movable terminal members 141 and 161 are press-fit into and fixed to the lower housing main body 71, and the misinsertion preventing member 130 is attached to the lower housing main body 71, so that the lower housing module 70 is completed.

(Attachment Process of the Upper Housing 100)

Figure 10:
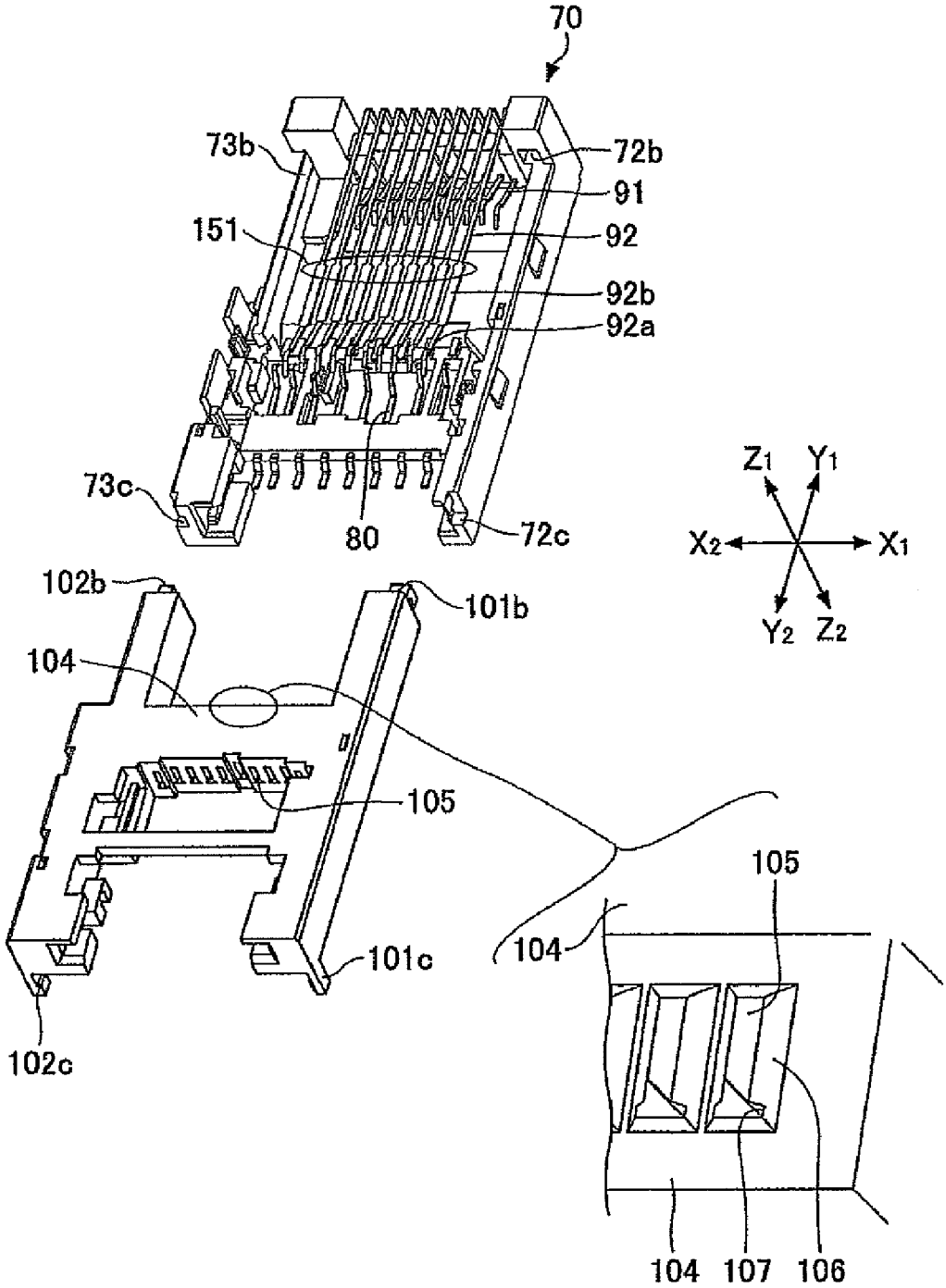
FIG. 10 is a perspective view of the lower housing module where the contact arm parts are bent and an upper housing to be combined with the lower housing module according to the embodiment of the present invention.
Figure 11:
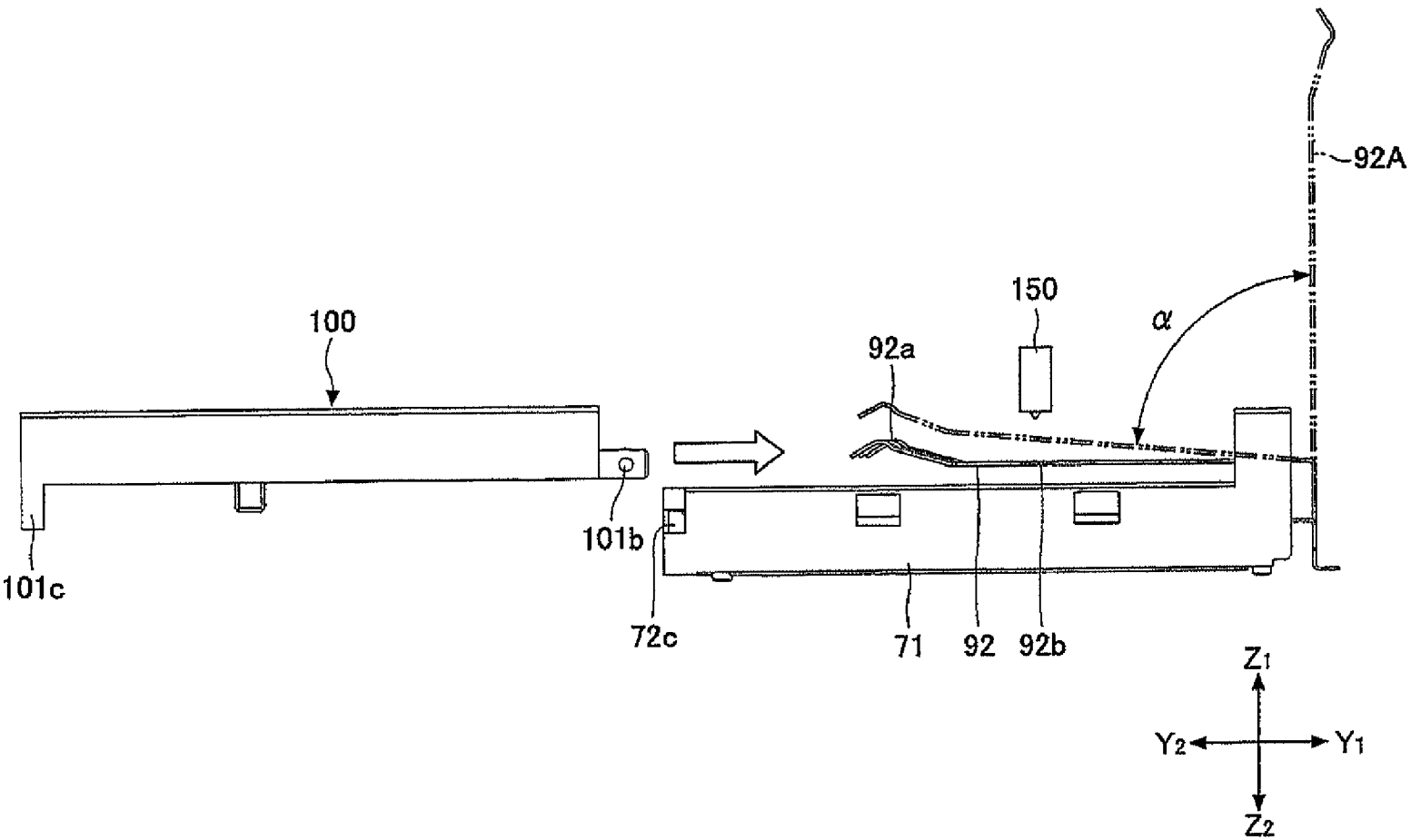
FIG. 11 is a side view showing the upper housing and the lower housing module of FIG. 10 according to the embodiment of the present invention.

As shown in FIG. 10 and FIG. 11, the upper housing 100 is placed on the lower housing main body 71 of the lower housing module 70 at its $Y_2$ end, and is caused to slide in the $Y_1$ direction along the upper surface of the lower housing main body 71.

The contact parts 92*a* are guided by the tapered parts 106 to be smoothly fit into the corresponding though holes 105, and pass through the through holes 105 to project in the $Y_2$ direction. Next, the bulge parts 92*b* are tightly fit into the corresponding slit parts 107 at the $Z_2$ ends of the through holes 105. Projections 101*b* and 102*b* of the upper housing 100 are fit into recesses 72*b* and 73*b* of the frame rods 72 and 73, respectively, and projections 101*c* and 102*c* of the upper housing 100 are fit into recesses 72*c* and 73*c* of the frame rods 72 and 73, respectively, so that the upper housing 100 is positioned, and is engaged with and fixed to the lower housing module 70.

The bulge parts 92*b* in the middle of the contact arm parts 92 are fit into and fixed to the corresponding slit parts 107, and the contact parts 92*a* are aligned to correspond to the arrangement of the terminals of the memory stick Duo 50.

Here, the contact arm parts 92 are bent at an angle α, which is several degree less than 90°, that is, at an angle a little shallower than 90°, in consideration of variations in the bending angle as indicated by two-dot chain lines in FIG. 11. In sliding the upper housing 100, the contact arm parts 92 are bent just 90° by pressing a portion 151 (FIG. 9) of the bent contact arm parts 92 (the Y1 side portion of the bulge parts 92*b*) from above using a jig 150 having an end shaped like comb teeth, so that the contact parts 92*a* are aligned with accuracy and the contact arm parts 92 are prevented from being buckled at the time of press-fitting. As a result, the multiple through holes 105 are smoothly fit to the corresponding contact parts 92*a*, and the bulge parts 92*b* are press-fit into the corresponding slit parts 107 without causing buckling of the contact arm parts 92.

(Attachment Process of Cover Member 120)

Referring back to FIG. 3 and FIG. 4, the cover member 120 has openings 122*a* and 123*a* of its side plate parts 122 and 123 fit to corresponding projections 72*d* and 73*d*, respectively, of the lower housing main body 71 so as to be fixed to and cover the stacked lower housing module 70 and upper housing 100.

[Vertical Position Accuracy of Lead Terminal Parts 94 of Memory Card Connector 60]

The memory card connector 60 has the upper housing 100 positioned on the lower housing module 70 with the upper housing 100 being fit to the contact parts 92*a*, the projections 101*b* and 102*b* being fit into the recesses 72*b* and 73*b*, respectively, and the projections 101*c* and 102*c* being fit into the recesses 72*c* and 73*c*, respectively. The openings 122*a* and 123*a* of the side plate parts 122 and 123 being fit to the corresponding projections 72*d* and 73*d*, respectively, of the lower housing main body 71, so that the cover member 120 is fixed to and covers the stacked lower housing module 70 and upper housing 100. The misinsertion preventing member 130 is supported between the lower housing main body 71 and the upper housing 100. The lead terminal parts 94 arranged in the $X_1$-$X_2$ directions have good surface accuracy.

The memory card connector 60 is assembled as described above. As a result, variations (error) in the attachment of the upper housing 100 onto the lower housing module do not affect variations in the vertical positions of the lead terminal parts 94 corresponding to the contact arm parts 92 inside the upper housing 100, and the vertical positions of the lead terminal parts 94 arranged in the $X_1$-$X_2$ directions relative to the lower surface of the memory card connector 60 are determined with more accuracy than conventionally. Accordingly, as shown in FIG. 5, in the case of mounting the memory card connector 60 on the printed circuit board 10, the lead terminal parts 94 come into contact with the corresponding pads 10*d* of the printed circuit board 10 and it is ensured that the lead terminal parts 94 are soldered to the corresponding pads 10*d*, thereby solving the problem of some lead terminal parts being not soldered to and out of contact with the corresponding pads 10*d* of the printed circuit board 10.

[Attachment of Memory Card to Memory Card Connector 60]

Referring to FIG. 3 and FIG. 5, the lower housing module 70 has an internal space for attachment of the SD memory card 20, the memory stick 30, and the multimedia card 40. The upper housing 100 has an internal space for attachment of the memory stick Duo 50.

When the memory stick Duo 50 is not attached to the memory card connector 60, the SD memory card 20, the memory stick 30, or the multimedia card 40 is selectively attached to the memory card connector 60 using the lower insertion slot 62. The SD memory card 20 is attached to the memory card connector 60 by having its terminals come into contact with the corresponding contact members 80. The multimedia card 40 is also attached to the memory card connector 60 by having its terminals come into contact with the corresponding contact members 80. The memory stick 30 is attached to the memory card connector 60 by having its terminals come into contact with the corresponding contact arm parts 91.

A description is given of the relationship between the memory stick 30 and the contact members 80.

Figure 12:
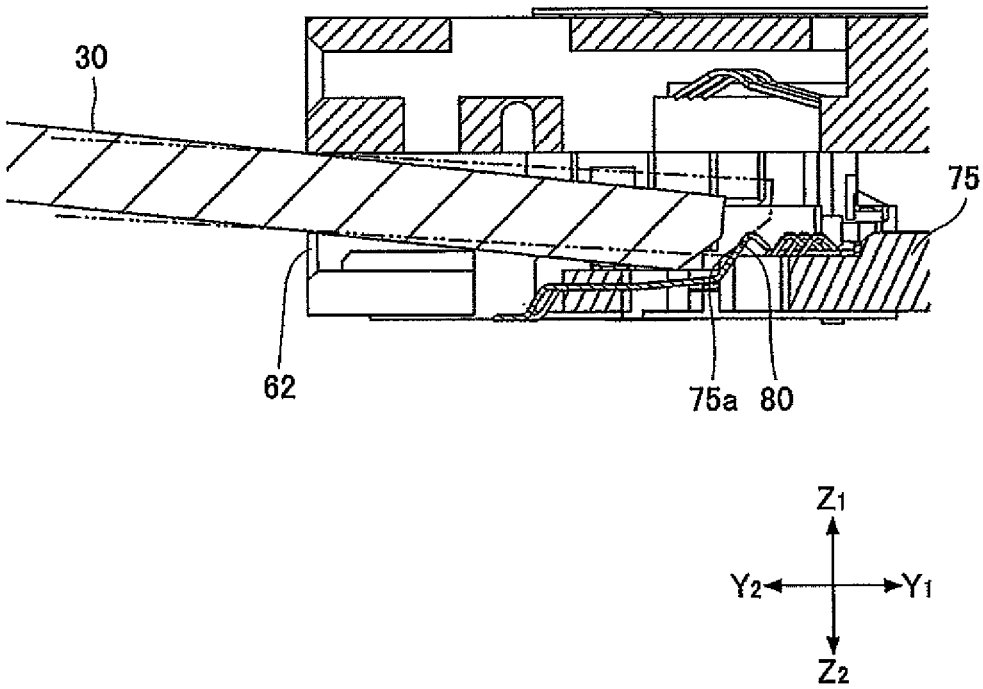
FIG. 12 is a diagram showing the path of the movement of the end of a memory stick in the middle of its insertion according to the embodiment of the present invention.

FIG. 12 is a diagram showing the path of the movement of the end of the memory stick 30 in the middle of its insertion.

The memory stick 30 is inserted into the corresponding space inside the lower housing module 70 to pass over the upper side of the contact members 80 to reach the bottom of the space.

An operator may insert the memory stick 30 into the lower insertion slot 62 with its rear end side lifted in the $Z_1$ direction. In this case, at the beginning of insertion, the memory stick 30 passes over the upper side of the contact members 80 in an inclined position with its front (leading) end side down as shown in FIG. 12. At this point, the end side of the contact members 80 may be excessively bent in the $Z_2$ direction, so that in some cases, the contact members 80 may have their respective ends plastically deformed in the $Z_2$ direction.

Therefore, according to this embodiment, the lower housing main body 71 has the projection parts 75*a* projecting in the $Z_1$ direction in a $Y_2$-side depressed part of the horizontally laid part 75, that is, a part corresponding to the ends of the contact members 80.

Thus, even if the memory stick 30 is inserted in an inclined position with its front end down, the memory stick 30 is positioned on the projection parts 75*a* to be forcibly displaced in the $Z_1$ direction as indicated by two-dot chain lines in FIG. 12 before the end of the memory stick 30 reaches the ends of the contact members 80, and moves over the contact members 80. As a result, the deformation of the end parts of the contact members 80 in the $Z_2$ direction is limited so as to prevent plastic deformation of the contact members 80.

On the other hand, when none of the SD memory card 20, the memory stick 30, and the multimedia card 40 is attached to the memory card connector 60, the memory stick Duo 50 is attached to the memory card connector 60 using the upper insertion slot 63. The memory stick Duo 50 is attached to the memory card connector 60 by having its terminals come into contact with the corresponding contact arm parts 92.

If any of the SD memory card 20, the memory stick 30, and the multimedia card 40 is attached to the memory card connector 60, the attached memory card itself closes the lower insertion slot 62 to prevent another memory card from being attached through the lower insertion slot 62. Further, if any of the SD memory card 20, the memory stick 30, and the multimedia card 40 is attached to the memory card connector 60, the misinsertion preventing member 130 is pressed in the $Y_1$ direction by the attached memory card to be rotated approximately 90° in the counterclockwise direction in FIG. 5, so that the triangular parts 131 and 132 (FIG. 4) project into the internal space of the upper housing 100 to prevent the memory stick Duo 50 from being attached to the memory card connector 60 in the upper housing 100.

If the memory stick Duo 50 is attached to the memory card connector 60, the misinsertion preventing member 130 is held by the attached memory stick Duo 50, so that the triangular parts 131 and 132 project into the internal space of the lower housing main body 71 to prevent the SD memory card 20, the memory stick 30, or the multimedia card 40 from being attached to the memory card connector 60 in the lower housing main body 71.

In the present invention, the double-contact members 90 are configured to have the two contact arm parts 91 and 92. This does not cause any inconvenience or compatibility problems because the memory stick Duo 50 has the same terminal arrangement as the memory stick 30 and is prevented from being attached to the memory card connector 60 when the memory stick 30 is attached thereto.

According to one embodiment of the present invention, the contact members 90 each having the contact arm part 91, the contact arm part 92, and the lead terminal part 94 may be replaced with contact members each having the contact arm part 92 and the lead terminal part 94.

Next, a description is given of the first and second detection switches 140 and 160.

The memory card connector 60 has the first detection switch 140 and the second detection switch 160 provided therein.

[Structures of First Detection Switch 140 and Second Detection Switch 160]

Figure 13B:
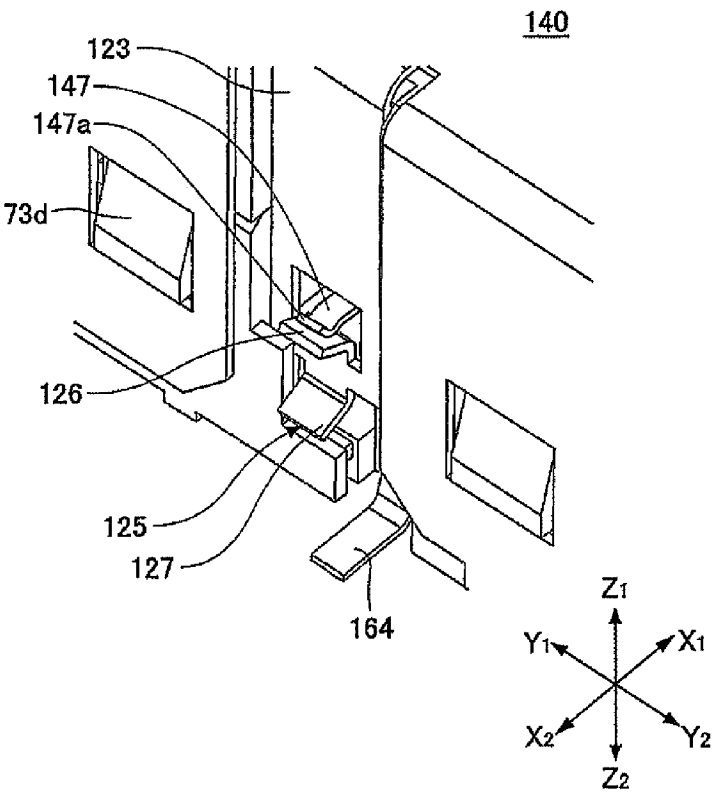
FIGS. 13A and 13B are perspective views of a first detection switch of the memory card connector according to the embodiment of the present invention.
Figure 13A:
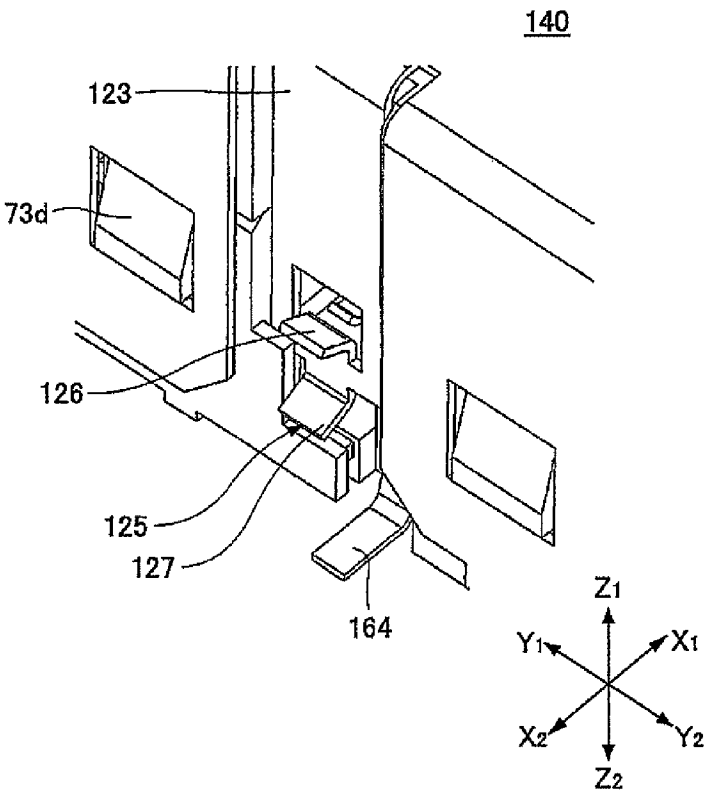
Figure 14B:
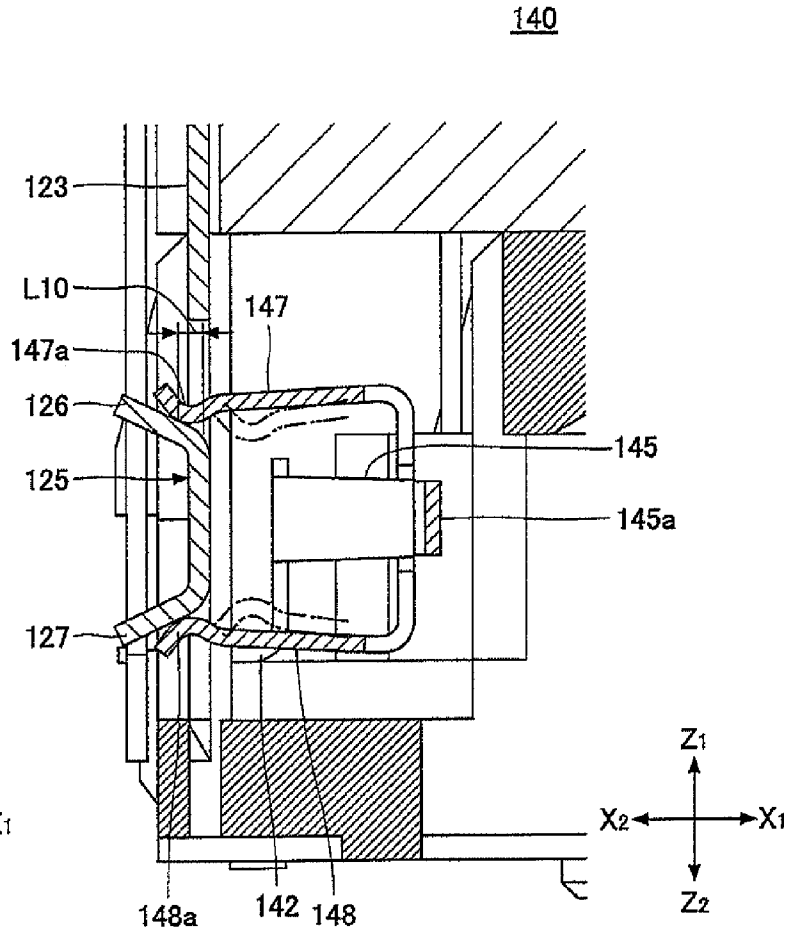
FIGS. 14A and 14B are cross-sectional views of the first detection switch according to the embodiment of the present invention.
Figure 14A:
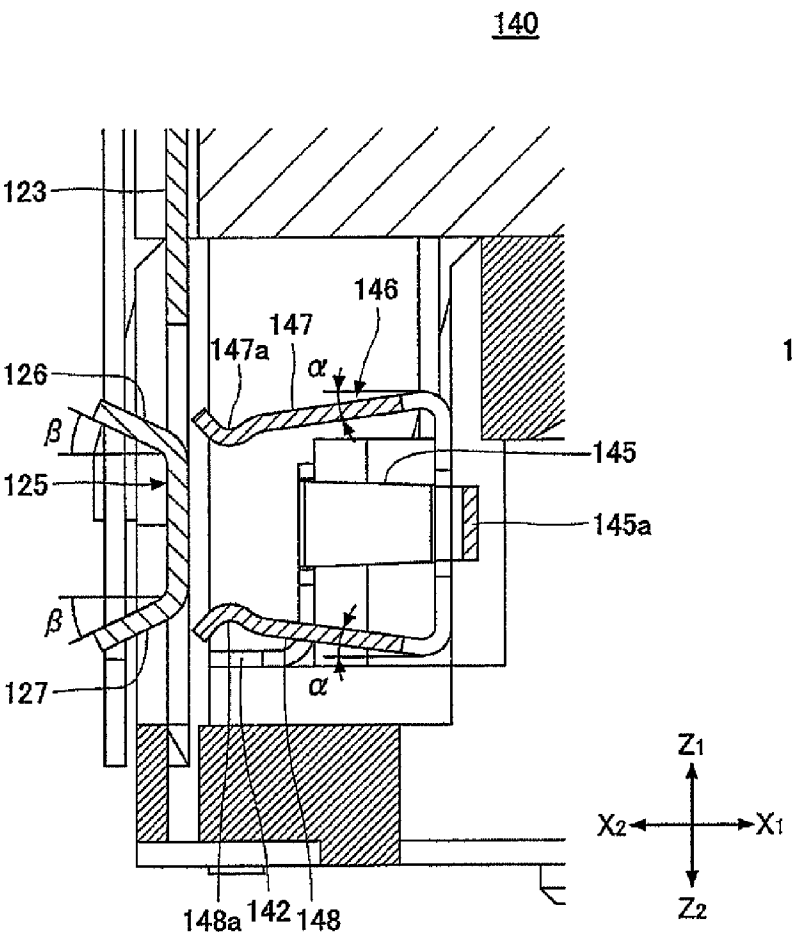

FIG. 13A and FIG. 14A shows the normal state, that is, the OFF state, of the first detection switch 140. FIG. 13B and FIG. 14B shows the first detection switch 140 turned ON into an operating state.

Figure 15:
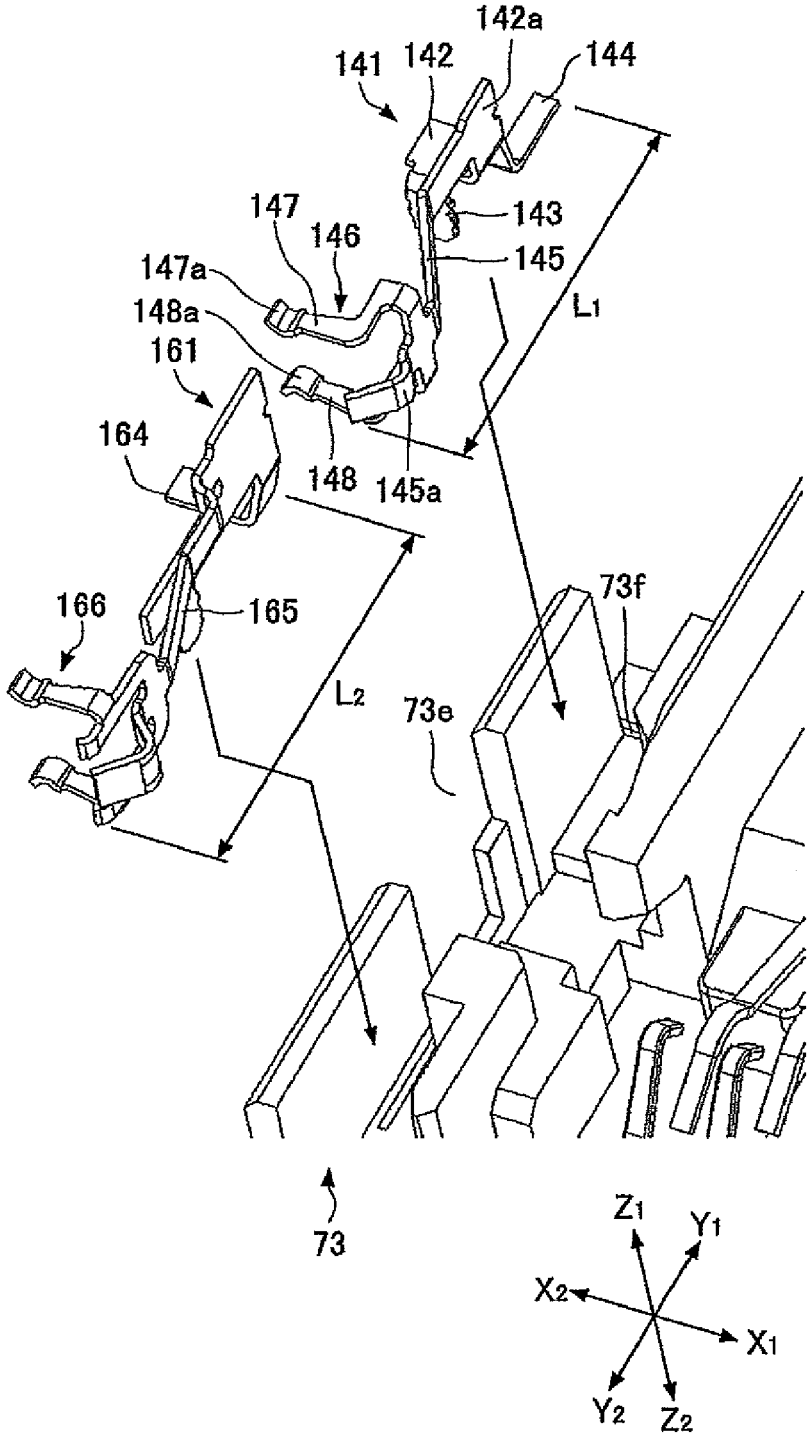
FIG. 15 is a diagram showing a movable terminal member of the first detection switch, a movable terminal member of a second detection switch, and part of a lower housing main body into which part the movable terminal members are incorporated according to the embodiment of the present invention.

FIG. 15 is a diagram showing the movable terminal member 141 of the first detection switch 140, the movable terminal member 161 of the second detection switch 160, and part of the lower housing main body 71 to which part the movable terminal members 141 and 161 are press-fit and fixed.

The upper surface of the frame rod 73 of the lower housing main body 71 is shaped so that the movable terminal member 141 and the movable terminal member 161 are press-fit into and fixed to the frame rod 73 so as to be accommodated.

The first detection switch 140 detects attachment of the SD memory card 20 or the multimedia card 40. The first detection switch 140 includes the movable terminal member 141 and the fixed terminal part 125 formed by cutting and raising part of the side plate part 123 of the cover member 120.

In FIGS. 14A and 14B, the movable terminal member 141 is shown with the same orientation as the orientation with which the movable terminal member 141 is fixed to the frame rod 73.

Referring to FIG. 15, the movable terminal member 141, which is a component formed of a metal plate by press molding, includes a base 142; a bulge part 143, a lead terminal part, and a long arm part 145 extending in different directions from the base 142; and a contact part 146 at the end of the arm part 145. The contact part 146 is shaped like a horseshoe and is three-dimensional.

The bulge part 143 is bent in the $Z_2$ direction from the base 142. The lead terminal part 144 has an L-letter shape and extends in the $Y_1$ direction from the base 142.

The base 142 has a part 142*a* thereof bent in the $Z_1$ direction, and the arm part 145 extends in the $Y_2$ direction from the bent part 142*a*. The arm part 145 is positioned in the Y-Z plane, and is elastically bendable so that its end is displaced in the $X_2$ direction. The arm part 145 includes a V-shaped end part 145*a* projecting in the $X_1$ direction.

The contact part 146 includes two symmetrical lead parts 147 and 148. The lead parts 147 and 148 each have a crank shape. The lead parts 147 and 148 stem from the arm part 145 in directions perpendicular to the arm part 145, that is, in the $Z_1$ and $Z_2$ directions, to be bent and extend in the $X_2$ direction. The lead parts 147 and 148 form a shape like a horseshoe lying on its side in a view from the $Y_2$ side (FIGS. 14A and 14B). The lead parts 147 and 148 stem from the arm part 145 and extend in the $X_2$ direction, that is, extend in the direction in which the arm part 145 is elastically bendable. Further, referring also to FIG. 14A, the lead parts 147 and 148 include respective end parts 147*a* and 148*a* projecting toward each other. Further, the lead parts 147 and 148 are symmetrically inclined at an angle α to reduce the distance (or narrow the gap) between the end parts 147*a* and 148*a*. The angle α is approximately 10°.

The movable terminal member 141 is attached to the frame rod 73 with the bulge part 143 being press-fit into a slit 73*f* of the frame rod 73, thereby having the base 142 fixed to the frame rod 73. The contact part 146 has its end side facing an opening part 73*e* formed in the frame rod 73. The contact part 146 is deformable in the $X_1$-$X_2$ directions by the bending of the arm part 145. That is, the contact part 146 is displaced in the direction in which the end of the arm part 145 is bent.

Referring to FIG. 13A and FIG. 14A, the fixed terminal part 125 is formed on the side plate part 123 of the cover member 120 by cutting and raising a part of the side plate part 123, and has a substantially trapezoidal cross section taken along the X-Z plane. The fixed terminal part 125 includes lug parts 126 and 127 each bent in the $X_2$ direction from the side plate part 123. The $Z_1$-side lug part 126 and the $Z_2$-side lug part 127 are symmetrically inclined to increase the distance (widen the gap) between their respective end parts when viewed from their base side. That is, the lug part 126 and the lug part 127 are inclined outward (away from each other) at an angle β relative to the direction in which the contact part 146 moves (the $X_2$ direction) The angle β is approximately 25°. That is, the fixed terminal part 125 is shaped to be rubbed by the end parts 147*a* and 148*a* of the contact part 146 when the contact part 146 is displaced in the direction in which the end of the arm part 145 is bent. There is a relationship of $\beta>\alpha$ between α and β.

Referring to FIG. 14A, when the first detection switch 140 is OFF, the contact part 146 faces the fixed terminal part 125 with a space therebetween.

When the SD memory card 20 or the multimedia card 40 is inserted into and attached to the memory card connector 60, the SD memory card 20 or the multimedia card 40 has part of its $X_2$-side surface near the end in the insertion direction pressing away the end part 145*a* of the arm part 145 in the $X_2$ direction, so that the arm part 145 is bent in the $X_2$ direction. As a result, the contact part 146 is displaced in the $X_2$ direction to approach the fixed terminal part 125, so that the end parts 147*a* and 148*a* come into contact with the lug parts 126 and 127, respectively, to move in such a manner as to be positioned on the lug parts 126 and 127 while rubbing their surfaces. Consequently, the lead parts 147 and 148 mount the fixed terminal part 125 to be finally in the position as shown in FIG. 14B, when the first detection switch 140 is turned ON.

Here, the direction in which the contact part 146 is displaced (the $X_2$ direction) is the same as the direction in which the arm part 145 is bent (the $X_2$ direction). Therefore, the distance L10 (FIG. 14B) over which the end parts 147*a* and 148*b* move rubbing the lug parts 126 and 127, respectively, is several times longer than in the conventional switch. As a result, the wiping effect that removes a foreign object becomes stronger than it is conventionally.

Further, when the contact part 146 comes into contact with the fixed terminal part 125, the gap between the end parts 147*a* and 148*a* is forced to widen and elastically bend, so that the pressing force of the end parts 147*a* and 148*a* against the lug parts 126 and 127 increases. This also strengthens the wiping effect that removes a foreign object.

Further, the lead parts 147 and 148 of the contact part 146 hold the fixed terminal part 125 therebetween. Therefore, even if the contact part 146 is slightly out of alignment with the fixed terminal part 125 in the $Z_1$-$Z_2$ directions in the state shown in FIG. 13A, the position of the contact part 146 is corrected in the process of the contact part 146 coming into contact with the fixed terminal part 125, so that the end parts 147*a* and 148*a* stably contact the lug parts 126 and 127, respectively.

Accordingly, the first detection switch 140 has a higher reliability than conventionally, so that the memory card connector 60 has higher reliability than conventionally.

Figure 1:
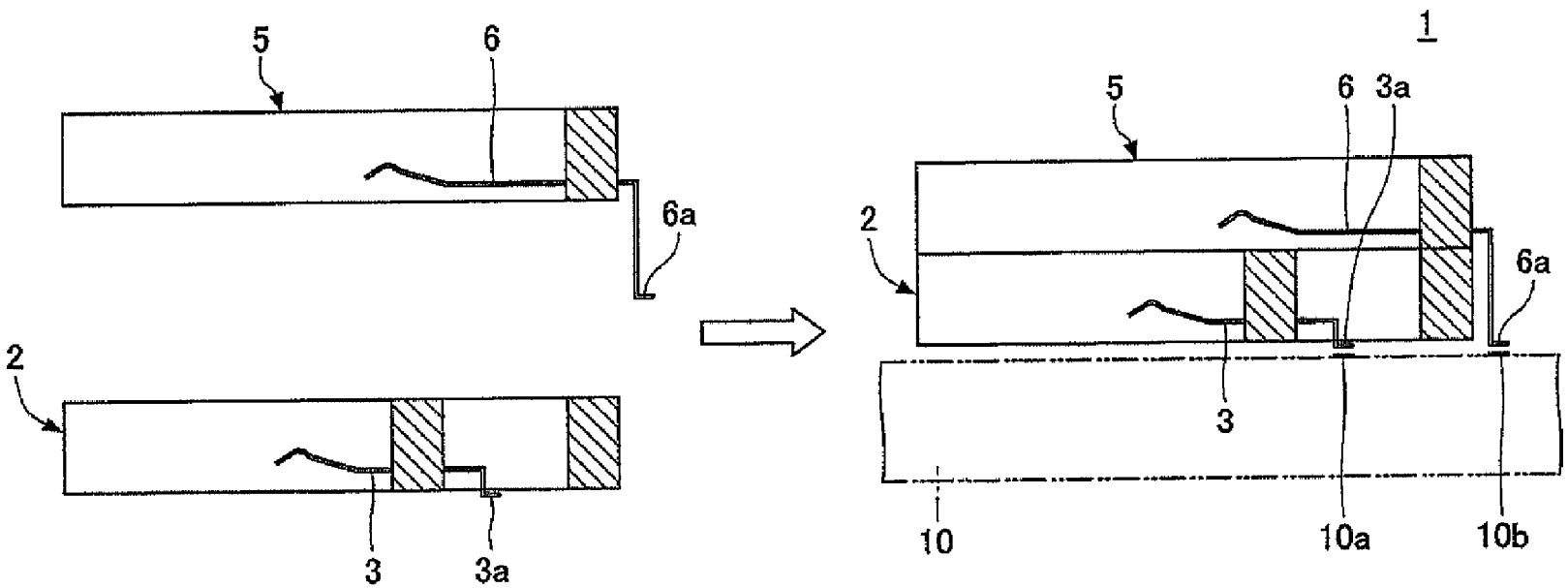
FIG.1 PRIOR ART
FIG. 1 is a schematic diagram showing a conventional memory card connector having a two-tier structure.
Figure 2A:
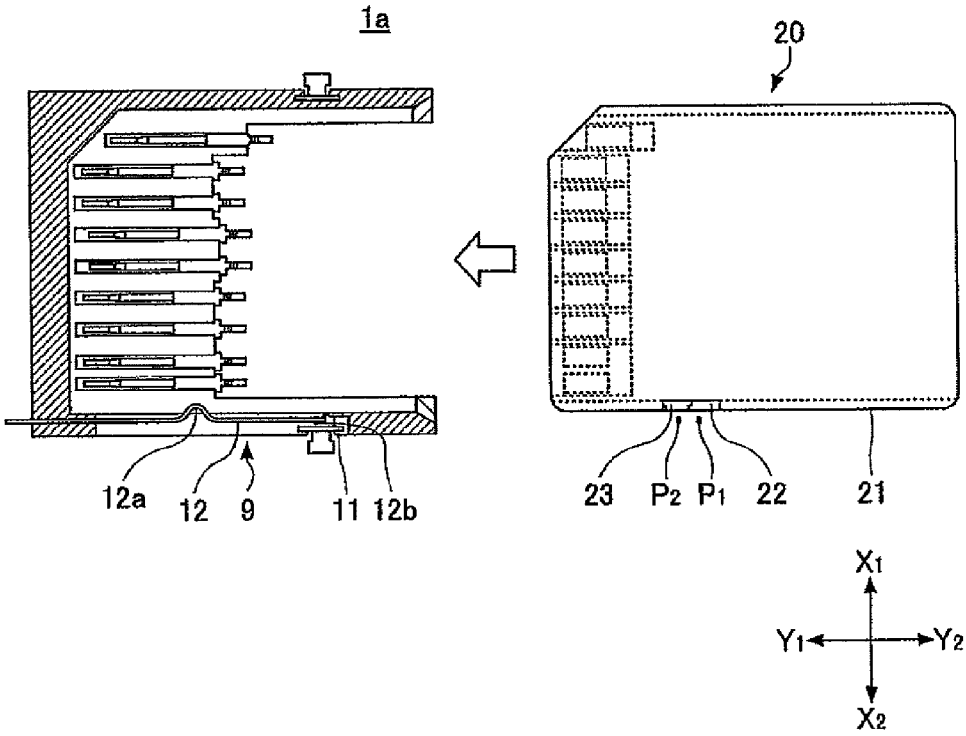
FIG.2A PRIOR ART
FIGS. 2A and 2B are diagrams for illustrating attachment of a memory card to a conventional memory card connector.
Figure 2B:
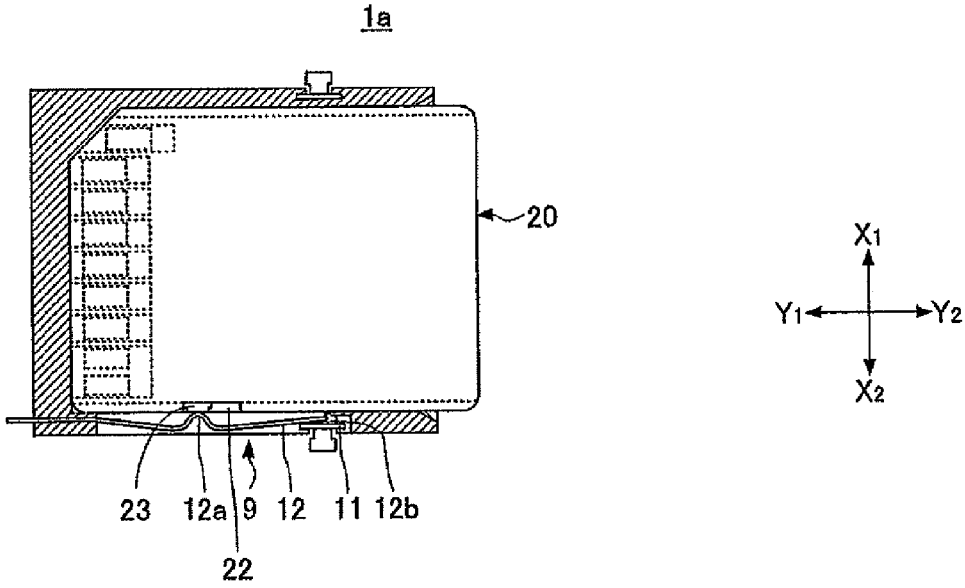
FIG.2B PRIOR ART

The second detection switch 160 detects that the knob 23 of the SD memory card 20 is set to the write enable position P2 (FIG. 2A). The second detection switch 160 includes the movable terminal member 161 and the fixed terminal part 129 (FIG. 3) formed by cutting and raising part of the side plate part 123 of the cover member 120.

Referring to FIG. 15, the movable terminal member 161, which is substantially the same as the above-described movable terminal member 141, includes a lead terminal part 164, an arm part 165, and a horseshoe contact part 166 at the end of the arm part 165. The fixed terminal part 129 is the same as the above-described fixed terminal part 125.

Accordingly, the second detection switch 160 operates in the same manner as the first detection switch 140 and has a higher reliability than conventionally, so that the memory card connector 60 has a higher reliability than conventionally.

The first and second detection switches 140 and 160 may be configured so that a single lead part rubs a corresponding lug part of the fixed terminal part (125, 129) by omitting one of the paired lead parts.

Figure 17B:
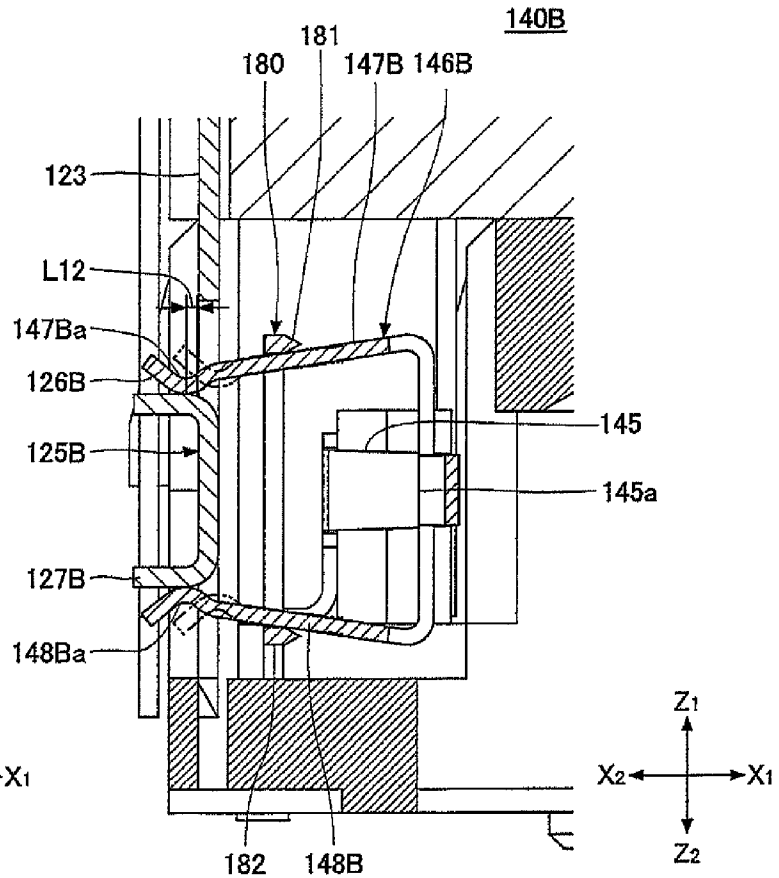
FIGS. 17A and 17B are cross-sectional views of a second variation of the first detection switch according to the embodiment of the present invention.
Figure 17A:
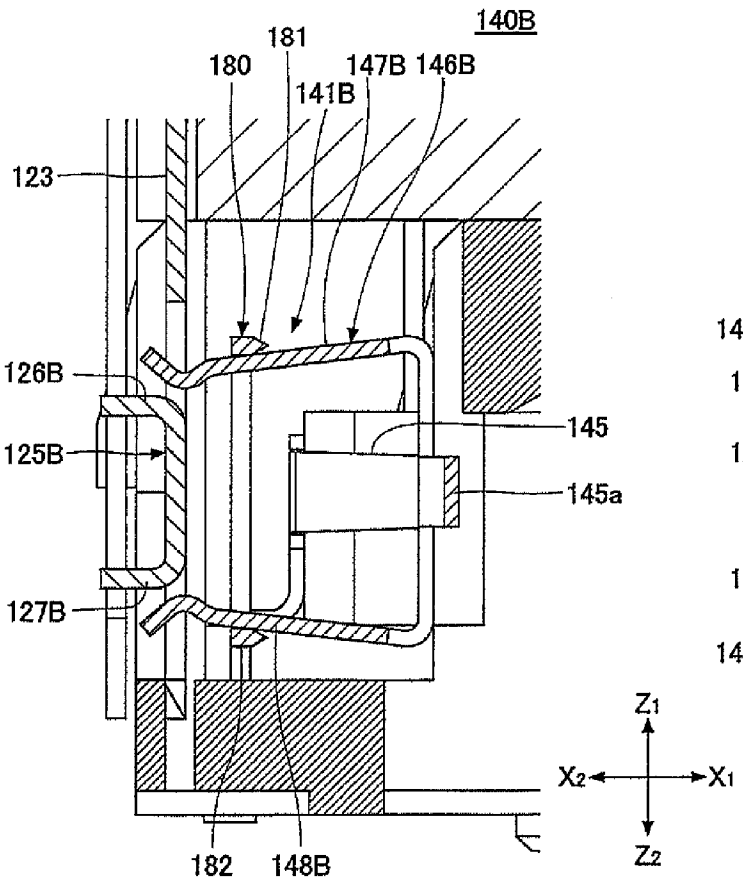

Further, the frame rod 73 may be provided with a frame part similar to a frame part 180 shown in FIGS. 17A and 17B so that the contact part 146 is positioned by the frame part when the first detection switch 140 is OFF.

In the case where the wiping direction is perpendicular to a direction in which the arm part is bent, the arm part is required to have a considerable length in order to increase the wiping distance, so that it is impossible to juxtapose the first and second detection switches. According to this embodiment, however, the wiping direction is the same as the direction in which the arm part is bent. Accordingly, the lengths L1 and L2 (FIG. 15) of the movable terminal members 141 and 161 may be small, so that the first and second detection switches 140 and 160 may be placed side by side on the frame rod 73.

The memory card connector 60 is mounted on the printed circuit board 10 of an electronic apparatus with leg parts 122*b* and 123*b* (FIG. 3 and FIG. 4) of the cover member 120 being screwed to the printed circuit board 10 and soldered to corresponding ground patterns thereof (not graphically illustrated), the lead terminal part 144 of the movable terminal member 141 and the lead terminal part 164 of the movable terminal member 161 being soldered to corresponding pads at the edge of the pattern of a detector circuit (not graphically illustrated) on the printed circuit board 10, and the lead terminal parts 81 and 94 of the contact members 80 and 90 being soldered to the corresponding pads 10*c* and 10*d* of the printed circuit board 10. Accordingly, when the first detection switch 140 or the second detection switch 160 is turned ON, the detector circuit suitably operates to control the electronic apparatus.

[Structures of Variations of First Detection Switch 140]

Figure 16B:
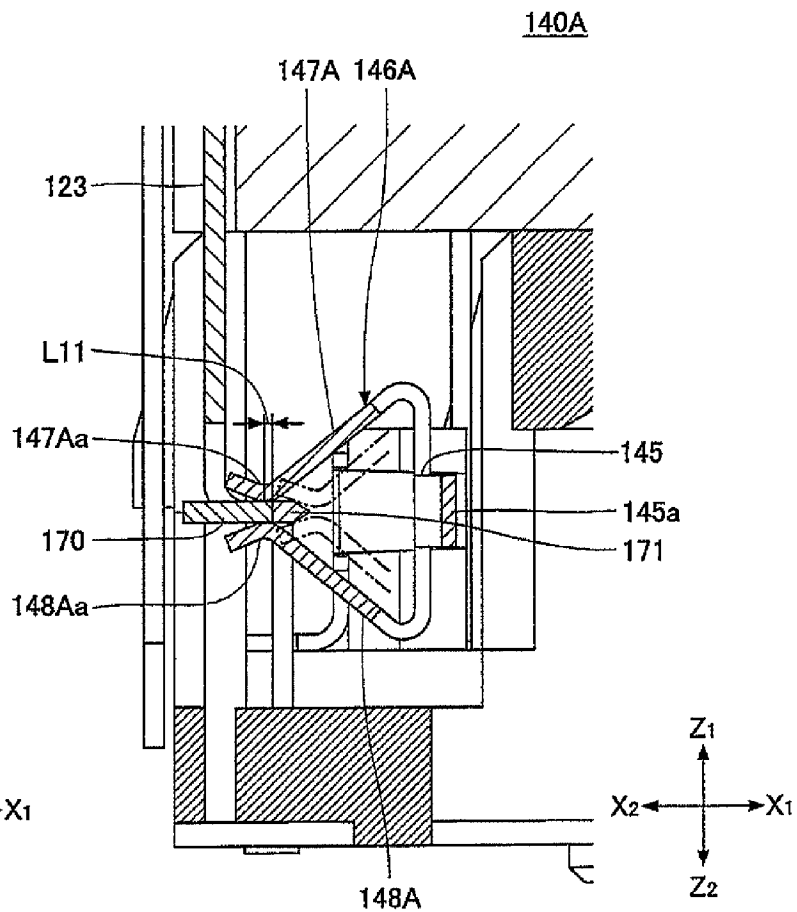
FIGS. 16A and 16B are cross-sectional views of a first variation of the first detection switch according to the embodiment of the present invention.
Figure 16A:
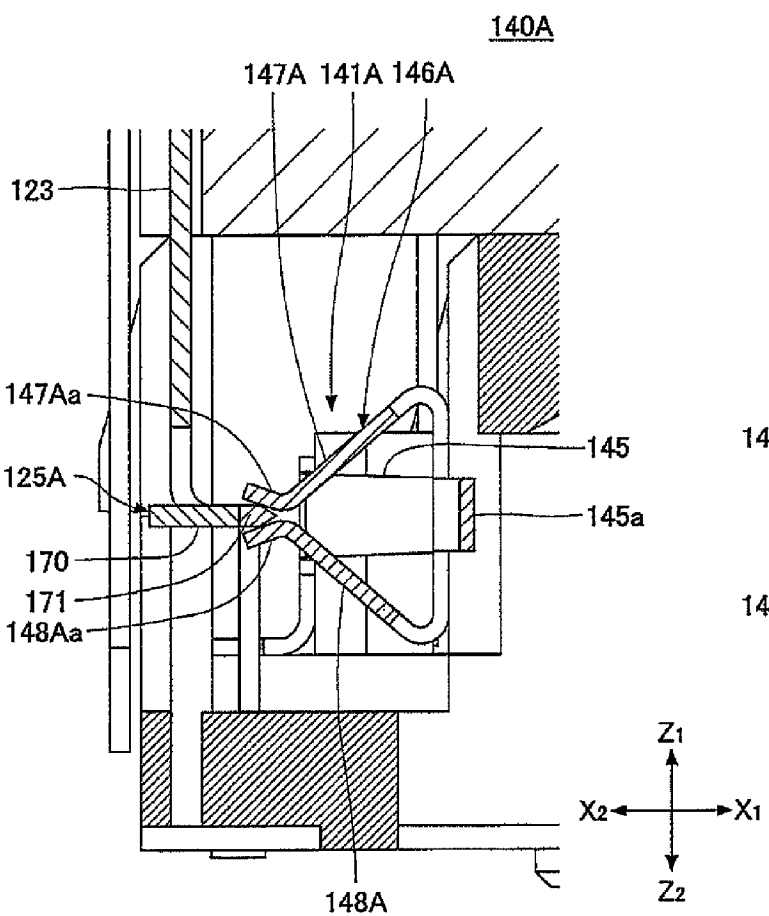

FIGS. 16A and 16B are diagram showing a first detection switch 140A, which is a first variation of the first detection switch 140.

The first detection switch 140A includes a movable terminal member 141A and a fixed terminal part 125A.

The movable terminal member 141A includes a contact part 146A. The contact part 146A includes lead parts 147A and 148A. The gap between the lead parts 147A and 148A narrows toward the ends thereof so that the contact part 146A has a triangular shape.

The fixed terminal part 125A has a horizontal lug part 170 bent in the $X_1$ direction, that is, bent toward the inside of the memory card connector 60. The frame rod 73 includes a tapered part 171 serving as a positioning part. The tapered part 171 is positioned at the end of the lug 170.

When the first detection switch 140A is OFF, end parts 147Aa and 148Aa of the lead parts 147A and 148A holds the tapered part 171 therebetween so that the contact part 146A is positioned as shown in FIG. 16A.

When the SD memory card 20 or the multimedia card 40 is inserted into and attached to the memory card connector 60, the arm part 145 is bent in the $X_2$ direction, so that the contact part 146A is displaced in the $X_2$ direction. As a result, the end parts 147Aa and 148Aa move over the tapered part 171, and the lead parts 147A and 148A are elastically deformed to widen the gap between the end parts 147Aa and 148Aa, so that the end parts 147Aa and 148Aa move while performing wiping, rubbing the corresponding surfaces of the lug part 170, to be in the state shown in FIG. 16B. The contact part 146A wipes the surfaces of the fixed terminal part 125A over a sufficient distance L11 (FIG. 16B). The lead parts 147A and 148A elastically hold the lug part 170 therebetween, so that the first detection switch 140A is turned ON.

FIGS. 17A and 17B are diagrams showing a first detection switch 140B, which is a second variation of the first detection switch 140.

The first detection switch 140B includes a movable terminal member 141B and a fixed terminal part 125B.

A contact part 146B of the movable terminal member 141B is larger than the contact part 146 of the above-described movable terminal member 141. The contact part 146B includes lead parts 147B and 148B that are inclined to narrow their gap toward the end side.

The fixed terminal part 125B includes horizontal lug parts 126B and 127B.

The frame rod 73 includes the frame part 180 serving as a positioning part. The frame part 180 includes upper and lower horizontally laid parts 181 and 182 serving as a guide part.

When the first detection switch 140B is OFF, the contact part 146B has its end side portion fit inside the frame part 180 with the upper surface of the end side portion of the lead part 147B contacting the upper horizontally laid part 181 and the lower surface of the end side portion of the lead part 148B contacting the lower horizontally laid part 182. The contact part 146B is positioned by the frame part 180, and faces the fixed terminal part 125B.

When the SD memory card 20 or the multimedia card 40 in inserted into and attached to the memory card connector 60, the arm part 145 is bent in the $X_2$ direction, so that the contact part 146B is displaced in the $X_2$ direction. As a result, the lead parts 147B and 148B are guided by the horizontally laid parts 181 and 182, respectively, to deform to narrow their gap toward the end side, so that the end parts 147Ba and 148Ba move while performing wiping, rubbing the surfaces of the corresponding lug parts 126B and 127B, so as to be in the state shown in FIG. 17B. The contact part 146B wipes the surfaces of the fixed terminal part 125B over a sufficient distance L12 (FIG. 17B). The lead parts 147B and 148B hold the fixed terminal part 125B therebetween, so that the first detection switch 140B is turned ON.

The detection switches 140 and 160 are applicable to card connectors to which not only memory cards but also a card-like object is attachable.

The memory stick 30 may correspond to a first card, the memory stick Duo 50 may correspond to a second card, the contact arm parts 91 may correspond to additional contact arm parts, and the contact arm parts 92 may correspond to contact arm parts.

According to one embodiment of the present invention, there is provided a card connector including a first housing configured to have a first card inserted thereinto to be attached thereto; a second housing configured to have a second card inserted thereinto to be attached thereto, the second housing being provided on the first housing; and a plurality of contact members for the second card combined with the first housing by insert molding, the contact members each having, at a first end, a contact arm part to come into contact with a terminal of the second card, and at a second end, a lead terminal part to be soldered to a pad on a board, wherein the contact arm parts are placed inside the second housing with intermediate portions thereof fixed to a part of the second housing.

According to one embodiment of the present invention, there is provided a card connector including a first housing configured to have a first card inserted thereinto to be attached thereto; a second housing configured to have a second card inserted thereinto to be attached thereto, the second card having a plurality of terminals arranged in correspondence to an arrangement of terminals of the first card, the second housing being provided on the first housing; a plurality of double-contact members having, at a first end, respective first contact arm parts corresponding to the terminals of the first card and respective second contact arm parts branching off from bases of the first contact arm parts and corresponding to the terminals of the second card, and having, at a second end, respective lead terminal parts to be soldered to corresponding pads on a board, wherein the double-contact members have the bases of the first contact arm parts combined with the first housing by insert molding, and the second contact arm parts are placed inside the second housing with respective intermediate portions thereof fixed to a part of the second housing.

According to one embodiment of the present invention, there is provided a method of assembling a card connector including a first housing configured to have a first card inserted thereinto to be attached thereto and a second housing configured to have a second card inserted thereinto to be attached thereto, the second housing being provided on the first housing, the method including the steps of combining a plurality of contact members for the second card with the first housing by insert molding, the contact members each having, at a first end, a contact arm part to come into contact with a terminal of the second card, and at a second end, a lead terminal part to be soldered to a pad on a board; bending the contact arm parts of the contact members combined with the first housing by insert molding so that the contact arm parts are parallel to a surface of the first housing facing toward the second housing with ends of the contact arm parts facing a side from which the first card is inserted; and attaching the second housing to the first housing by sliding the second housing on the surface of the first housing from the side from which the first card is inserted so that intermediate portions of the contact arm parts are fixed inside the second housing and the second housing is engaged with and fixed onto the first housing.

According to one embodiment of the present invention, there is provided a method of assembling a card connector including a first housing configured to have a first card inserted thereinto to be attached thereto and a second housing configured to have a second card inserted thereinto to be attached thereto, the second card having a plurality of terminals arranged in correspondence to an arrangement of terminals of the first card, the second housing being provided on the first housing, the method including the steps of combining bases of first contact arm parts of a plurality of double-contact members with the first housing by insert molding, the double-contact members having, at a first end, the respective first contact arm parts corresponding to the terminals of the first card and respective second contact arm parts branching off from the bases of the first contact arm parts and corresponding to the terminals of the second card, and having, at a second end, respective lead terminal parts to be soldered to corresponding pads on a board; bending the second contact arm parts of the double-contact members combined with the first housing by insert molding so that the second contact arm parts are parallel to a surface of the first housing facing toward the second housing with ends of the second contact arm parts facing a side from which the first card is inserted; and attaching the second housing to the first housing by sliding the second housing on the surface of the first housing from the side from which the first card is inserted so that intermediate portions of the second contact arm parts are fixed inside the second housing and the second housing is engaged with and fixed onto the first housing.

According to the above-described card connectors and methods of assembling a card connector, the contact members for the second card is combined with the first housing by insert molding, and the first housing does not include contact members for the second card and is placed on the first housing. Therefore, the vertical positions of the lead terminal parts are not affected by the accuracy of attachment of the second housing onto the first housing. Accordingly, it is possible to increase the accuracy of the vertical positions of the lead terminal parts compared with the structure where a second housing with which contact members for the second card are combined by insert molding is attached onto a first housing. As a result, in the case of mounting the card connector on a printed circuit board, there occurs no mounting failure where some lead terminal parts are out of contact with corresponding pads on the printed circuit board, so that it is possible to mount the card connector onto the printed circuit board with more accuracy.

According to one embodiment of the present invention, there is provided a card connector including a housing configured to have a card attached thereto; and a detection switch configured to detect the attachment of the card to the housing, the detection switch including a movable terminal configured to be pressed by the attached card to be elastically bent; and a fixed terminal spaced away from and facing the movable terminal, wherein the movable terminal includes an arm part configured to be pressed by the attached card to be elastically bent; and a contact part extending from the arm part in a direction in which the arm part is bent, the fixed terminal is shaped so as to be rubbed by the contact part in response to the bending of the arm part, and the contact part is configured to be displaced in the direction in which the arm part is bent so as to come into contact with and rub the fixed terminal in response to the bending of the arm part.

According to the above-described card connector, the contact part is displaced in the direction in which the arm part is bent so as to come into contact with and rub the fixed terminal. Therefore, the distance over which the contact part rubs the fixed terminal, that is, the wiping distance, can be significantly longer than it is conventionally, so that it is possible to increase the reliability of the detection switch and accordingly to increase the reliability of the card connector.

The present invention is not limited to the specifically disclosed embodiment, and variations and modifications may be made without departing from the scope of the present invention.

The present application is based on Japanese Priority Patent Applications No. 2007-279949 and No. 2007-279950, both filed on Oct. 29, 2007, the entire contents of which are hereby incorporated by reference.

What is claimed is:

1. A card connector, comprising:

a first housing configured to have a first card inserted thereinto to be attached thereto;

a second housing configured to have a second card inserted thereinto to be attached thereto, the second housing being provided on the first housing, the second housing having a plurality of through holes provided in a part thereof, the through holes each being open at a first end and a second end facing toward each other; and a plurality of contact members each having, at a first end, a contact arm part to come into contact with a terminal of the second card, and at a second end, a lead terminal part to be soldered to a pad on a board, the contact arm parts each having a bulge part in an intermediate portion thereof, the contact arm parts being placed inside the second housing and penetrating the second housing through the corresponding through holes to have the respective intermediate portions thereof press-fit into the through holes and fixed to the second housing at the through holes and have respective ends thereof projecting from the first ends of the through holes, wherein the first housing is a single insert molded component having the contact members combined with a housing body of the first housing by insert molding.

2. The card connector as claimed in claim 1, wherein:

the second card has a plurality of terminals arranged in correspondence to an arrangement of terminals of the first card, the contact members further include, at the first end, respective additional contact arm parts corresponding to the terminals of the first card, so that the respective contact arm parts branch off from bases of the corresponding additional contact arm parts, and the contact members have the bases of the additional contact arm parts combined with the housing body of the first housing by the insert molding.

3. The card connector as claimed in claim 1, wherein:

each of the through holes includes a first part through which the end of the corresponding contact arm part passes;

a second part into which the bulge part of the corresponding contact arm part is press-fit, the second part being formed at a lower end of the first part; and a tapered part formed at an entrance of the through hole on a side from which the end of the corresponding arm part passes through the through hole.

4. The card connector as claimed in claim 1, wherein:

the first housing includes a plurality of additional contact members combined with the housing body by insert molding; and a projection part projecting upward from the housing body, the projection part being provided on a side of ends of the additional contact members from which side the first housing is configured to have the first card inserted thereinto.

5. A method of assembling a card connector including a first housing and a second housing, comprising the steps of:

forming the first housing by combining a plurality of contact members with a housing body by insert molding, so that the first housing is configured to have a first card inserted thereinto to be attached thereto, the contact members each having, at a first end, a contact arm part to come into contact with a terminal of a second card, and at a second end, a lead terminal part to be soldered to a pad on a board, the contact arm parts each having a bulge part in an intermediate portion thereof;

bending the contact arm parts of the contact members combined with the first housing by insert molding so that the contact arm parts are parallel to a surface of the first housing with ends of the contact arm parts facing a side from which the first card is inserted; and attaching the second housing having a plurality of through holes each open at a first end and a second end facing toward each other to the first housing by sliding the second housing on the surface of the first housing from the side from which the first card is inserted so that the contact arm parts penetrate the second housing through the corresponding through holes through the first ends of the through holes to have the respective bulge parts thereof press-fit into the through holes and fixed to the second housing at the through holes and have respective ends thereof projecting from the second ends of the through holes and the second housing is engaged with and fixed onto the first housing, the second housing being configured to have the second card inserted thereinto to be attached thereto.

6. The method as claimed in claim 5, wherein:

the second card has a plurality of terminals arranged in correspondence to an arrangement of terminals of the first card, the contact members further include, at the first end, respective additional contact arm parts corresponding to the terminals of the first card, so that the respective contact arm parts branch off from bases of the corresponding additional contact arm parts, and said step of combining combines the bases of the additional contact arm parts with the housing body of the first housing by the insert molding.

7. The method as claimed in claim 5, wherein:

said step of bending bends the contact arm parts at a first angle slightly shallower than a second angle at which the contact arm parts are parallel to the surface of the first housing, and said step of attaching is performed with the contact arm parts being held using a jig so as to be aligned and parallel to the surface of the first housing.

8. A card connector, comprising:

a housing configured to have a card attached thereto;

a metal cover member covering the housing; and a detection switch configured to detect the attachment of the card to the housing, the detection switch including a movable terminal configured to be pressed by the attached card to be elastically bent and a fixed terminal formed as part of the metal cover member and spaced away from and facing the movable terminal, wherein the movable terminal includes an arm part configured to be pressed by the attached card to be elastically bent and a contact part extending from the arm part in a direction in which the arm part is bent, the fixed terminal is shaped so as to be rubbed by the contact part in response to the bending of the arm part, and the contact part is configured to be displaced in the direction in which the arm part is bent so as to come into contact with and rub the fixed terminal in response to the bending of the arm part.

9. A card connector, comprising:

a housing configured to have a card attached thereto; and a detection switch configured to detect the attachment of the card to the housing, the detection switch including a movable terminal configured to be pressed by the attached card to be elastically bent and a fixed terminal spaced away from and facing the movable terminal, wherein the movable terminal includes an arm part configured to be pressed by the attached card to be elastically bent and a contact part extending from the arm part in a direction in which the arm part is bent, the fixed terminal is shaped so as to be rubbed by the contact part in response to the bending of the arm part, the contact part is configured to be displaced in the direction in which the arm part is bent so as to come into contact with and rub the fixed terminal in response to the bending of the arm part, the contact part is formed by bending a lead branching off from the arm part, the fixed terminal includes a lug part formed in correspondence to the lead by cutting and raising a part of a side plate part of a metal cover member covering the housing, and the lead is configured to come into contact with and rub the lug part in response to the bending of the arm part.

10. The card connector as claimed in claim 9, wherein:

the lug part is inclined with respect to the direction in which the contact part is displaced so that a contact pressure of an end of the lead on the lug part increases as the end of the lead moves in rubbing contact with the lug part.

11. A card connector, comprising:

a housing configured to have a card attached thereto; and a detection switch configured to detect the attachment of the card to the housing, the detection switch including a movable terminal configured to be pressed by the attached card to be elastically bent and a fixed terminal spaced away from and facing the movable terminal, wherein the movable terminal includes an arm part configured to be pressed by the attached card to be elastically bent and a contact part extending from the arm part in a direction in which the arm part is bent, the fixed terminal is shaped so as to be rubbed by the contact part in response to the bending of the arm part, the contact part is configured to be displaced in the direction in which the arm part is bent so as to come into contact with and rub the fixed terminal in response to the bending of the arm part, the contact part is formed by bending a pair of leads branching off from the arm part, so as to have a horseshoe shape in a view from an end side of the arm part, the fixed terminal includes a pair of lug parts formed in correspondence to the leads by cutting and raising a part of a side plate part of a metal cover member covering the housing, and the leads are configured to come into contact with and rub the corresponding lug parts so as to hold the fixed terminal therebetween in response to the bending of the arm part.

12. The card connector as claimed in claim 11, wherein:

the lug parts are inclined away from each other with respect to the direction in which the contact part is displaced, so that a contact pressure of an end of each of the leads on the corresponding lug part increases as the end of each of the leads moves in rubbing contact with the corresponding lug part.

13. The card connector as claimed in claim 11, further comprising:

a positioning part configured to determine a position of the contact part by being fit to the contact part.

14. A card connector, comprising:

a housing configured to have a card attached thereto; and a detection switch configured to detect the attachment of the card to the housing, the detection switch including a movable terminal configured to be pressed by the attached card to be elastically bent and a fixed terminal spaced away from and facing the movable terminal, wherein the movable terminal includes an arm part configured to be pressed by the attached card to be elastically bent and a contact part extending from the arm part in a direction in which the arm part is bent, the fixed terminal is shaped so as to be rubbed by the contact part in response to the bending of the arm part, the contact part is configured to be displaced in the direction in which the arm part is bent so as to come into contact with and rub the fixed terminal in response to the bending of the arm part, the contact part is formed by bending a pair of leads branching off from the arm part so as to have a triangular shape narrowing toward ends of the leads in a view from an end side of the arm part, the fixed terminal includes a single lug part formed in correspondence to the leads by cutting a part of a side plate part of a metal cover member covering the housing and raising the part toward an inside of the card connector, and the leads are configured to have a gap between the respective ends widening so as to come into contact with and rub corresponding surfaces of the lug part and hold the lug part therebetween in response to the bending of the arm part.

15. The card connector as claimed in claim 14, further comprising a positioning part configured to determine a position of the contact part by being fit to the gap between the ends of the leads.

16. A card connector, comprising:

a housing configured to have a card attached thereto;

a detection switch configured to detect the attachment of the card to the housing, the detection switch including a movable terminal configured to be pressed by the attached card to be elastically bent and a fixed terminal spaced away from and facing the movable terminal; and a guide part, wherein the movable terminal includes an arm part configured to be pressed by the attached card to be elastically bent and a contact part extending from the arm part in a direction in which the arm part is bent, the fixed terminal is shaped so as to be rubbed by the contact part in response to the bending of the arm part, the contact part is configured to be displaced in the direction in which the arm part is bent so as to come into contact with and rub the fixed terminal in response to the bending of the arm part, the contact part is formed by bending a pair of leads branching off from the arm part, so as to have a horseshoe shape in a view from an end side of the arm part, the fixed terminal includes a pair of lug parts formed in correspondence to the leads by cutting and raising a part of a side plate part of a metal cover member covering the housing, the guide part is configured to guide exterior surfaces of the bent leads so as to deform the leads in a direction to narrow a gap therebetween toward an end side thereof in response to the displacement of the contact part, and the leads are configured to be deformed in the direction to narrow the gap therebetween toward the end side thereof by the guide part so as to come into contact with and rub the corresponding lug parts and hold the fixed terminal therebetween in response to the bending of the arm part.

17. A card connector, comprising:

a housing configured to have a card attached thereto;

a detection switch configured to detect the attachment of the card to the housing, the detection switch including a movable terminal configured to be pressed by the attached card to be elastically bent and a fixed terminal spaced away from and facing the movable terminal; and an additional detection switch configured to detect a write-enable state of the attached card, the detection switch including an additional movable terminal configured to be pressed by the attached card to be elastically bent and an additional fixed terminal spaced away from and facing the additional movable terminal, wherein the movable terminal includes an arm part configured to be pressed by the attached card to be elastically bent and a contact part extending from the arm part in a direction in which the arm part is bent, the fixed terminal is shaped so as to be rubbed by the contact part in response to the bending of the arm part, the contact part is configured to be displaced in the direction in which the arm part is bent so as to come into contact with and rub the fixed terminal in response to the bending of the aim part, and the detection switch and the additional detection switch are arranged so as to face a same surface of the attached card.

* * * * *